US006741821B2

(12) United States Patent
Sugino et al.

(10) Patent No.: US 6,741,821 B2
(45) Date of Patent: May 25, 2004

(54) IMAGE FORMING APPARATUS, AND PROCESS CARTRIDGE FOR USE IN IMAGE FORMING APPARATUS

(75) Inventors: Akihiro Sugino, Shizuoka (JP); Yuuji Sawai, Yokohama (JP); Mitsuru Takahashi, Kanagawa (JP); Kohki Katoh, Tokyo (JP); Katsuya Kawagoe, Tokyo (JP); Hiromi Ogiyama, Tokyo (JP); Takahiro Tamiya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/178,685

(22) Filed: Jun. 25, 2002

(65) Prior Publication Data

US 2003/0035660 A1 Feb. 20, 2003

(30) Foreign Application Priority Data

Jun. 26, 2001 (JP) ..... 2001-192317

(51) Int. Cl.[7] ..... G03G 21/16

(52) U.S. Cl. ..... 399/111; 399/116

(58) Field of Search ..... 399/111, 112, 399/116, 298, 299, 302, 308, 159

(56) References Cited

U.S. PATENT DOCUMENTS

| | | | | |
|---|---|---|---|---|
| 4,740,441 | A | 4/1988 | Otomura | 430/63 |
| 4,942,104 | A | 7/1990 | Kitajima et al. | 430/56 |
| 5,028,502 | A | 7/1991 | Yuh et al. | 430/31 |
| 5,100,453 | A | 3/1992 | Richards | 65/27 |
| 5,339,138 | A | 8/1994 | Mishima et al. | 399/93 |
| 5,411,827 | A | 5/1995 | Tamura et al. | 430/58 |
| 5,483,330 | A | 1/1996 | Ogiyama et al. | |
| 5,496,671 | A | 3/1996 | Tamura et al. | 430/58 |
| 5,508,789 | A | 4/1996 | Castelli et al. | 399/8 |
| 5,578,405 | A | 11/1996 | Ikegami et al. | 430/59 |
| 5,599,645 | A | 2/1997 | Tamiya et al. | |
| 5,702,855 | A | 12/1997 | Ikegami et al. | 430/83 |
| 5,740,492 | A | 4/1998 | Deki et al. | |
| 5,789,128 | A | 8/1998 | Adachi et al. | 430/83 |
| 5,834,145 | A | 11/1998 | Yoshinaga et al. | 430/31 |
| 5,846,680 | A | 12/1998 | Adachi et al. | 430/73 |
| 5,870,650 | A | 2/1999 | Takahashi et al. | |
| 5,890,030 | A | 3/1999 | Namekata et al. | |
| 5,910,561 | A | 6/1999 | Adachi et al. | 528/196 |
| 5,928,828 | A | 7/1999 | Suzuki | 430/126 |
| 5,942,363 | A | 8/1999 | Tanaka et al. | 430/75 |

(List continued on next page.)

FOREIGN PATENT DOCUMENTS

| | | |
|---|---|---|
| EP | 1 089 132 | 4/2001 |

OTHER PUBLICATIONS

U.S. patent application Ser. No. 10/178,685, Sugino et al., filed Jun. 25, 2002.

U.S. patent application Ser. No. 10/660,699, Ishibashi et al., filed Sep. 12, 2003.

*Primary Examiner*—Hoan Tran
(74) *Attorney, Agent, or Firm*—Oblon, Spivak, McClelland, Maier & Neustadt, P.C.

(57) ABSTRACT

An image forming apparatus comprises a latent image support which supports an electrostatic latent image. A charging unit charges a surface of the image support. A latent image formation unit forms an electrostatic latent image on the image support surface. A developing unit develops the latent image with toner to form a toner image. A transfer unit transfers the toner image from the image support to a recording medium. A transport unit transports the recording medium so that the image support surface is countered to a surface of the recording medium. The surface of the image support has a coefficient of friction ranging from 0.1 to 0.7 according to Euler belt method, and a difference between a speed of the image support and a speed of the recording medium is below 1%, and the image support has an outermost surface containing a filler and a binder resin.

6 Claims, 9 Drawing Sheets

U.S. PATENT DOCUMENTS 5,999,773 A 12/1999 Yasutomi et al. ..... 399/148
6,026,262 A 2/2000 Kinoshita et al. ..... 399/252
6,030,736 A 2/2000 Ikegami et al. ..... 430/59.6
6,035,157 A 3/2000 Takahashi et al.
6,069,224 A 5/2000 Adachi et al. ..... 528/198
6,118,964 A 9/2000 Kojima et al. ..... 399/174
6,134,416 A 10/2000 Tamiya
6,136,483 A 10/2000 Suzuki et al. ..... 430/58.7
6,142,690 A 11/2000 Yoshimura et al. ..... 399/299 X
6,163,661 A 12/2000 Namekata et al.
6,163,669 A * 12/2000 Aoki et al. ..... 399/159
6,184,910 B1 2/2001 Sasaki et al.
6,191,249 B1 2/2001 Tanaka et al. ..... 528/196
6,212,351 B1 4/2001 Kawagoe et al.
6,249,304 B1 6/2001 Sawayama et al. ..... 347/228
6,319,878 B1 11/2001 Ina et al. ..... 503/200
6,322,940 B1 11/2001 Nishigaki et al. ..... 430/58.65
6,326,112 B1 12/2001 Tamura et al.
6,366,751 B1 4/2002 Shakuto et al. ..... 399/159
6,432,596 B2 8/2002 Ikuno et al. ..... 430/58.05
6,444,387 B2 9/2002 Ri et al. ..... 430/67
6,492,079 B2 12/2002 Shimada et al. ..... 430/58.05

* cited by examiner

IMAGE FORMING APPARATUS, AND PROCESS CARTRIDGE FOR USE IN IMAGE FORMING APPARATUS

BACKGROUND OF THE INVENTION

1. Field of the Invention

The present invention relates to an image forming apparatus, such as a copier, a printer or a facsimile, and relates to a process cartridge used for the image forming apparatus. More specifically, the image forming apparatus of the present invention includes a plurality of image formation units. Each image formation unit includes a latent image support for supporting an electrostatic latent image, and a charging unit for charging the latent image support surface. A latent image formation unit forms an electrostatic latent image on the latent image support. A developing unit develops and forms the electrostatic latent image into a toner image. A transfer unit transfers the toner image on the latent image support to a recording medium. Moreover, the present invention relates to a process cartridge used for the image forming apparatus having the plurality of image formation units each equipped with the recording medium surface side the transfer unit to which the recording medium surface side is moved so that the surface of each latent image support of the image formation units is countered one by one.

2. Description of The Related Art

With the electro-photographic equipment, color printers and color copiers performing color image formation are increasing with the demand from the market today.

Among the color electro-photographic equipment, there is a one-drum type image forming apparatus in which the surroundings of one photoconductor are equipped with the developing units of two or more colors, a toner is adhered with those developing units, a synthetic toner image is formed on the photoconductor, the toner image is transferred to a copy sheet, and it is fixed as a printed color image on the copy sheet. On the other hand, there is a tandem type image forming apparatus in which two or more photoconductors are equipped with individual developing units respectively, a monochrome toner image is formed on each photoconductor respectively, those monochrome toner images are transferred one by one, a synthetic color image is printed on a copy sheet.

A description will now be given of comparison between the one-drum type and the tandem type. In the one-drum type, the number of photoconductors is one, and the miniaturization can be easily attained and the one-drum type has the advantage that the cost reduction is possible. However, in order to repeat the image formation two or more times (usually 4 times) using one photoconductor and to form a full color image, the improvement in the speed of image formation is difficult.

On the other hand, in the case of the tandem type, the scale of the equipment becomes large, which causes a problem that the equipment becomes expensive. However, the tandem type image forming apparatus has an advantage that the improvement in the speed of image formation is easy.

There is an increasing demand for a full color image being formed at a high speed that is the same as the speed of monochrome image formation, and the tandem type has attracted attention.

In the case of the tandem type, four photoconductors are arranged in parallel for each color image formation of cyan, magenta, yellow and black, and the image forming apparatus of the tandem type needs to make smaller the diameter of each of the photoconductors and shorten the distances between the four photoconductors, in order to create more space, reduce the equipment size, and achieve cost saving.

As a transfer method to transfer a toner image from a photoconductor to a recording medium, there are an indirect transfer method in which a bias roller is arranged at a downstream portion of the photoconductor, and a direct impression method in which the pressure of an elastic roller as a bias roller on the photoconductor is directly applied to a recording medium between the elastic roller and the photoconductor.

FIG. 7 shows a direct transfer method in a conventional tandem type image forming apparatus. As shown in FIG. 7, in the direct transfer method, an image on each of photoconductors 1 is transferred to a recording sheet "s", which is transported by a sheet transport belt 3, by using a corresponding one of transfer units 2, respectively.

In a conventional indirect transfer method, if the diameter of each of the photoconductors and the distances between the photoconductors are reduced in order for the miniaturization and cost saving, it becomes difficult to control the electric current which flows from the bias roller into the photoconductor.

FIG. 6 shows an indirect transfer method in a conventional tandem type image forming apparatus. In FIG. 6, reference numeral 40BK indicates a photoconductor for a black image, reference numeral 40Y indicates a photoconductor for a yellow image, and reference numeral 10 indicates an intermediate transfer belt which is brought into contact with these photoconductors in common.

As shown in FIG. 6, a bias roller 603BK pushes up the intermediate transfer belt 10 indirectly from the upstream side of the intermediate transfer belt 10 about the photoconductor 40BK in the conveyance direction. The pressure of the belt 10 is applied to the intermediate transfer belt 10 against the photoconductor 40BK. Reference numeral 603BK' indicates an auxiliary roller, and the auxiliary roller 603BK' currently pushes up the intermediate transfer belt 10 from the downstream side of the intermediate transfer belt 10 about the photoconductor 40BK.

Similarly, reference numeral 603Y indicates a bias roller for the photoconductor 40Y, and reference numeral 603Y' indicates an auxiliary roller.

The auxiliary rollers 603BK and 603Y are grounded respectively, and the bias roller 603BK and 603Y are connected to bias power supplies, respectively. For example, if the electric current i2 which flows to the ground side from the bias roller 603BK is larger than the electric current i1 which flows into the photoconductor 40BK, it becomes difficult to keep constant the electric current i1 which flows into the photoconductor 40BK.

The intermediate transfer belt is usually made of a material with middle resistance, and when changes of resistance and electrostatic capacitance according to the environment cause the electric current i2 to fluctuate, it is very difficult to maintain the transfer conditions of the intermediate transfer belt uniformly by keeping the electric current i1 constant.

The ratio of the electric current i2 to the electric current i1 becomes large as the distance L between the photoconductor 40BK and the photoconductor 40Y becomes small. The electric current control will become more difficult in such a case. To avoid this, the bias roller is arranged at the downstream side of the photoconductor in the rotation direction of the intermediate transfer belt 10. Moreover, to avoid the influences on the other photoconductors as much as possible, it is necessary to take a slightly large distance between the photoconductors and more space than the direct transfer method.

For this reason, in order to attain the miniaturization of equipment, in the tandem type image forming apparatus having the four-drum photoconductors and the intermediate transfer mechanism, the direct transfer method is adopted in many cases. By the direct transfer method, the bias roller serves as a configuration which counters a photoconductor from the front through the intermediate transfer belt, and the electric current which flows into the photoconductor decreases very much, and it becomes possible to keep constant the electric current which flows into the photoconductor.

However, the bias roller is pressurized by the photoconductor from the front through the intermediate transfer belt when adopting the direct transfer method, and the pressure acts on the toner on the photoconductor surface greatly. The toner image tends to be condensed, and the toner at a certain spot of the image on the photoconductor remains without transfer. There is a problem that an undesired image which lacks the toner corresponding to the spot is formed on the recording paper.

In order to avoid the problem of the undesired image, the speed difference in the surface speed of the photoconductor and the recording medium is preset according to a conventional method. However, according to this method, the transfer accuracy at the time of transferring of a toner image from the photoconductor to the recording medium will become worse, and dot reproducibility and thin-line reproducibility will degrade.

Furthermore, the tandem type image forming apparatus requires high accuracy with respect to the respective rotation speed of the photoconductors and the transfer speed of the recording medium. This is because irregularity of the rotation of each drive system, the gap of rotating speeds, etc. cause color gap and a banding image immediately. Therefore, although the speed difference has arisen not a little in the surface speed of the photoconductor and the recording medium by these factors, establishing the speed difference intentionally at the surface speed of the photoconductor and the recording medium will cause degradation of the image quality.

Moreover, the surface abrasion loss of the four photoconductors by the repetition image output in the tandem type image forming apparatus is not uniform. According to the kind of toner, the coating weight, the number of times of development, the material of a contact member and the variation of the transfer pressure, etc., the surface abrasion loss is varied and a difference in the circumference of each photoconductor occurs. Therefore, the speed difference of the surface speeds of the photoconductors and the recording medium also becomes large by expansion of the circumference difference.

When the surface frictional coefficient of a photoconductor is small, the contact portion of an electro-photographic photoconductor and a recording medium can cancel the strain of the recording medium by the speed difference with a slight slippage of the recording medium while the strain is small. On the other hand, when the surface frictional coefficient of a photoconductor is large, the contact portion cannot slip easily, and the contact portion slips only after the strain of the recording medium is accumulated and a larger pressure is applied to the recording medium. If the cancellation of such strain due to the slippage becomes severe, it will cause a banding image to appear, and will become a factor of degradation of the image quality.

SUMMARY OF THE INVENTION

An object of the present invention is to provide an improved image forming apparatus in which the above-described problems are eliminated.

Another object of the present invention is to provide a tandem type image forming apparatus that can reliably prevent the occurrence of an undesired image, such as color gap and banding, over an extended period of time.

Another object of the present invention is to provide a process cartridge used for a tandem type image forming apparatus which can prevent the occurrence of an undesired image, such as color gap and banding, over an extended period of time.

The above-mentioned objects of the present invention are achieved by an image forming apparatus which image forming apparatus having a plurality of image formation units, each image formation unit comprising: a latent image support supporting an electrostatic latent image; a charging unit charging a surface of the image support; a latent image formation unit forming an electrostatic latent image on the image support surface; a developing unit developing the electrostatic latent image with toner to form a toner image on the image support; and a transfer unit transferring the toner image from the image support to a recording medium, the image forming apparatus comprising a recording medium transnsport unit transporting the recording medium so that the surfaces of the image supports of the plurality of image formation units are countered to a surface of the recording medium, respectively, wherein the surface of each image support has a coefficient of friction that is in a range of 0.1 to 0.7 according to Euler belt method, and a difference between a rotation speed of each image support and a transport speed of the recording medium is below 1%, and each image support has an outermost surface containing at least a filler and a binder resin.

The above-mentioned objects of the present invention are achieved by a process cartridge for use in an image forming apparatus, the image forming apparatus comprising: a main body; a latent image support supporting an electrostatic latent image; a charging unit charging a surface of the image support; a latent image formation unit forming an electrostatic latent image on the image support surface; a developing unit developing the electrostatic latent image with toner to form a toner image on the image support; a transfer unit transferring the toner image from the image support to a recording medium; and a recording medium transnsport unit transporting the recording medium so that the surface of the image support is countered to a surface of the recording medium, wherein the process cartridge includes the image support and at least one of the charging unit, the image formation unit, the developing unit, the transfer unit and an image support cleaning unit, which are integrally provided in the process cartridge, and the process cartridge is provided to be removable from the main body, wherein the surface of the image support has a coefficient of friction that is in a range of 0.1 to 0.7 according to Euler belt method, and a difference between a rotation speed of the image support and a transport speed of the recording medium is below 1%, and the image support has an outermost surface containing at least a filler and a binder resin.

According to the image forming apparatus and the process cartridge of the present invention, the change of the outside diameter of a latent image support can be made small even in the repetition use or over an extended period of time, and it is possible to reliably form a good full color image without outputting a banding image.

BRIEF DESCRIPTION OF THE DRAWINGS

Other objects, features and advantages of the present invention will be apparent from the following detailed description when read in conjunction with the accompanying drawings.

DETAILED DESCRIPTION OF PREFERRED EMBODIMENTS

A description will now be given of a preferred embodiment of the present invention which is applied to a color electro-photographic copier, with reference to the accompany drawngs.

Figure 1:
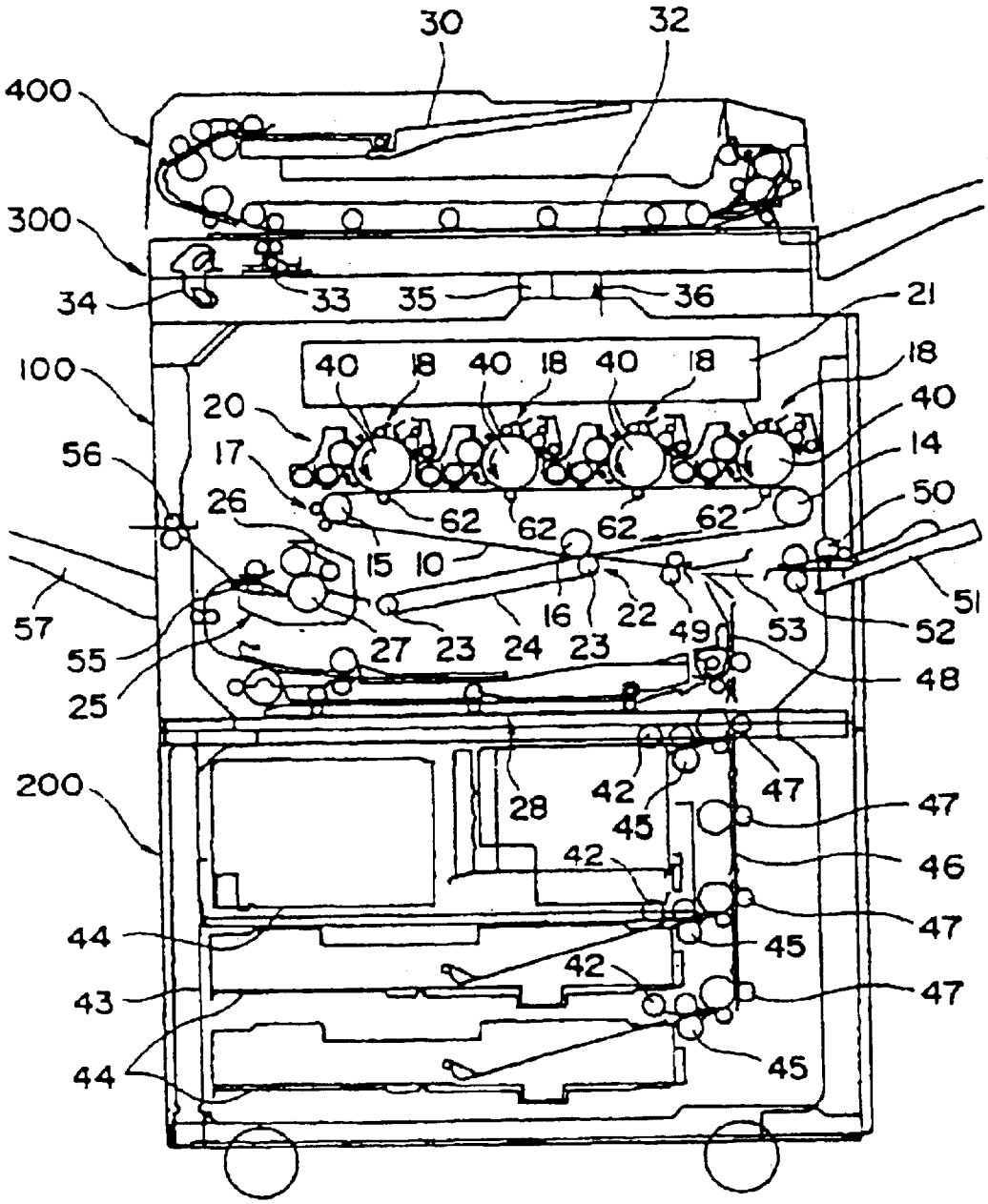
FIG. 1 is a diagram showing one embodiment of a tandem type image forming apparatus of the present invention.

FIG. 1 shows a tandem-type color electro-photographic copier using the indirect transfer method to which the preferred embodiment of the present invention is applied.

This color electro-photographic copier generally includes a main body 100 which contains an image reproduction mechansim, a paper feed table 200 on which the main body of the copier is mounted, a scanner 300 which is attached to the main body, and an automatic document feeder (ADF) 400 which is further attached to the scanner.

The endless intermediate transfer belt 10 is provided in the center at the main body 100. In the embodiment of FIG. 1, the intermediate transfer belt 10 is wound on three support rollers 14, 15, and 16, and the rotation of the belt in the clockwise direction in FIG. 1 is possible.

In the present embodiment, the intermediate transfer belt cleaning unit 17 is provided on the left of the second support roller 15 of the three support rollers 14, 15 and 16. The cleaning unit 17 cleans the remaining toner on the intermediate transfer belt 10 after the image transfer.

Moreover, on the intermediate transfer belt 10 stretched between the first support roller 14 and the second support roller 15 along the conveyance direction, four image formation units 18 of cyan, yellow, magenta and black are arranged side by side horizontally, so that the tandem image forming apparatus 20 is constituted. In the tandem image forming apparatus 20, as shown in FIG. 1, the exposure unit 21 is further provided.

On the opposite side of the intermediate transfer belt 10 to the tandem image forming apparatus 20, the secondary transfer unit 22 is provided. The secondary transfer unit 22 includes the secondary transfer belt 24 which is an endless belt wound between two rollers 23. Through the intermediate transfer belt 10, it is pressed against the third support roller 16. The secondary transfer unit 22 is configured to transfer the image on the intermediate transfer belt 10 to a recording sheet by using the secondary transfer belt 24.

Moreover, the fixing unit 25 which fixes the transfer image to the recording sheet is provided beside the secondary transfer unit 22. The fixing unit 25 includes the pressure roller 27 which presses the fixing belt 26 (which is an endless belt) against the recording sheet.

In addition, in paralle with the tandem image forming apparatus 20 of the present embodiment, the lower portion of the secondary transfer unit 22 and the fixing unit 25 is provided with the sheet turnover device 28. The sheet turnover device 28 serves to invert a recording sheet with an image be recorded on one side thereof, and transport the inverted recording sheet to the image forming units so that an image will be recorded on the other side thereof.

When taking a copy using the above-described color electro-photographic copier, a document is set on the document stand 30 of the automatic document feeder 400. Otherwise, the automatic document feeder 400 is opened, a document is set on the contact glass 32 of the scanner 300, and the automatic document feeder 400 is closed such that the document is held.

When the document is set on the ADF 400 and the start button (not shown) of the copier is pressed, the scanner 300 is driven at the time of conveying the document to the contact glass 32. When the document is set on the contact glass 32 and the start button is pressed, the scanner 300 is driven immediately. The document is passed through the first running member 33 and the second running member 34. The document is irradiated by light from the light source of the first running member 33, and the reflected light from the document is reflected further by the mirror of the second running member 34 towards the second running member 34. The reflected light is read through the focusing lens 35, and sent to the reading sensor 36, so that the information of the document is optically read.

Moreover, when the start button is pressed, the rotation of one of the support rollers 14, 15 and 16 is driven by a drive motor (not shown), the follower rotation of the other support rollers is performed, and the conveyance of the intermediate transfer belt 10 is performed.

Simultaneously, each of the photoconductors 40 is rotated by the corresponding image formation unit 18, and the monochrome images of black, cyan, yellow and magenta are formed on the respective photoconductors 40. And, with the conveyance of the intermediate transfer belt 10, those monochrome images are transferred one by one to the intermediate transfer belt 10, and a synthetic color image is formed on the intermediate transfer belt 10.

On the other hand, when the start button is pressed, the rotation of a selected one of the feed rollers 42 of the feed table 200 is performed, and a recording sheet is taken out from one of the feed cassettes 44 provided in the paper bank 43. One recording sheet is separated by the separation roller 45, and it is sent to the feed way 46. The sheet is transported with the conveyance roller 47 and sent to the feed way 48 in the main body 100 of the copier. The sheet is stopped by the resist roller 49. Otherwise, the sheet on a manual tray 51 is taken out by the rotation of the paper feeding roller 50, and with the separation roller 52, one sheet is separated at a time, and it is sent to the manual feeding passage 53. The sheet is stopped by the resist roller 49.

And the timing is synchronized with the formation of the synthetic color image on the intermediate transfer belt 10, and the resist roller 49 is rotated to send the sheet to the space between the intermediate transfer belt 10 and the secondary transfer unit 22. The color image is transferred to the sheet by the secondary transfer unit 22, so that a color image is recorded on the sheet.

The sheet after the image transfer is transported to the fixing unit 25 by the secondary transfer unit 22, and heat and pressure are applied to the sheet by the fixing unit 25. The image is fixed to the sheet. The transport direction of the sheet is switched by the change nail 55, and the sheet is ejected by the ejection roller 56 so taht the sheet is stacked on the ejection tray 57. Otherwise, the transport direction is switched by the change nail 55, and the sheet is sent to the sheet turnover device 28. The sheet is reversed at the sheet turnover device 28, and sent to the transfer position again, an image is recorded on the back of the recording sheet. The sheet is ejected to the ejection tray 57 by the discharge roller 56.

On the other hand, the intermediate transfer belt 10 after the image transfer is cleaned by the intermediate transfer belt cleaning unit 17, and the remaining toner on the intermediate transfer belt 10 after the image transfer is removed. The intermediate transfer belt 10 is then placed in a waiting condition for a subsequent image formation by the tandem image forming apparatus 20.

The resist roller 49 is grounded in many cases, but it is also possible to apply a bias voltage for paper chip removal of a recording sheet. Generally, in the intermediate transfer method, paper chips may be hardly transferred to the photoconductor, and the necessity of taking the paper chip transfer into consideration may be omitted. The grounding of the resist roller 49 is possible. Moreover, as the applied voltage, a DC bias is applied, but an AC voltage with a DC offset component is sufficient as this in order to perform uniform charging of the sheet. Thus, the paper surface after passing the resist roller 49 which is charged by the bias voltage is set to a slight negative polarity. Therefore, in the image transfer from the intermediate transfer belt 10 to the recording sheet, the transfer conditions may change to the resist roller 49 compared with the case where the bias voltage is not applied, and the transfer conditions may be changed.

Figure 2:
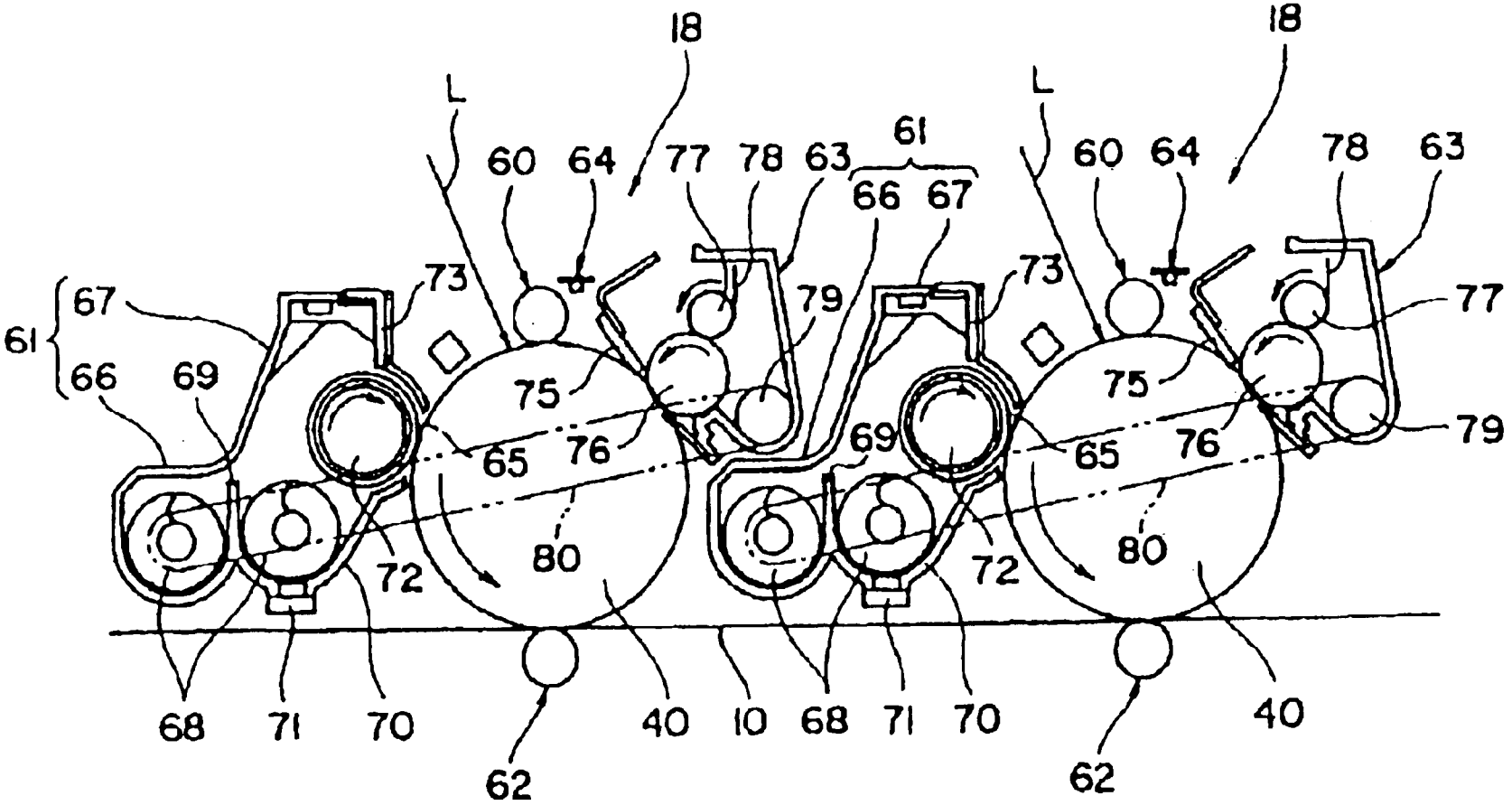
FIG. 2 is an enlarged FIG. of the periphery of a photoconductor in the image forming apparatus of FIG. 1.

FIG. 2 shows the periphery of the photoconductor in the image forming apparatus of FIG. 1. In the above-described tandem image forming apparatus 20, each image formation unit 18 is configured such that the charging unit 60, the developing unit 61, the primary transfer unit 62, the photoconductor cleaning unit 63 and the electric discharger 64 are arranged around the peripheray of the drum-like photoconductor 40 as sshown in FIG. 2.

A conventional intermediate transfer belt is made of any of the following materials: a fluorine including resin, a polycarbonate resin, a polyimide resin, etc. However, in recent years, an elastic belt is used as the intermediate transfer belt, and in the elastic belt, all the layers of the belt or some layers of the belt are made of elastic members.

In addition, the transfer of a color image using the conventional resin belt has the following problem. A color image is usually formed by the coloring toners of four colors. In the color image of a recording sheet is comprised of the toner layers including the first to fourth toner layers. The toner layers receive pressure when the recording sheet is sujected to a primary transfer (transfer to the intermediate transfer belt from the photoconductor) and to a secondary transfer (transfer to the recording sheet from the intermediate transfer belt), and the force of coagulation of the toner particles becomes high. If the force of coagulation becomes high, it will become easy to generate the phenomenon of the inside omission of a character, or the edge omission of a solidly colored image. Since a resin belt does not change hardness according to the toner layers, that it is easy to make the toner layers compress, it is easy to generate the inside omission phenomenon of a character.

Moreover, there is an increasing demand of attaching irregularity to various copy sheets, including Japanese paper, in forming an image by a full color image forming apparatus. However, in a case of a copy sheet with poor flatness, the toner and the opening tend to be created at the time of image transfer, and the omission of image transfer becomes easy to occur.

In order to raise adhesion, when the transfer pressure of the secondary transfer unit is raised, the condensation power of the toner layer will be increased and the omission of character inside is likely to take place.

The above-mentioned elastic belt is used by the following aim. Since the hardness of the elastic belt is lower than the hardness of a resin belt, the elastic belt easily deforms at the transfer unit corresponding to the toner layers and the recording sheet with poor flatness. That is, the homogeneous transfer image can be obtained with the recording sheet with poor flatness, and good adhesion is obtained by the elastic belt which does not cause the inside omission of a character. The transfer pressure to the toner layers is not raised too much in the case of the elastic belt, which follows the local irregularity by the deformation of the elastic belt.

As a material of the elastic belt, one or plural materials may be chosen from the following group of resin materials. The group of resin materials include polycarbonate, fluorine including resin (ETFE, PVDF), polystyrene, chloropolystyrene, poly-alpha-methyl styrene, styrene butadiene copolymer, styrene vinyl chloride copolymer, styrene vinyl acetate copolymer, styrene maleic acid copolymer, styrene acrylic-ester copolymer (styrene methyl acrylate copolymer, styrene ethyl acrylate copolymer, styrene butyl-acrylate copolymer, styrene acrylic acid octyl copolymer, styrene acrylic acid phenyl copolymer, etc.), styrene methacrylic-ester copolymer (styrene methyl methacrylate copolymer, styrene ethyl-methacrylate copolymer, styrene methacrylic acid phenyl copolymer, etc.), styrene resin (single polymer or copolymer containing styrene or styrene substitution product), styrene-alpha-chloromethyl acrylate copolymer and styrene acrylonitrile acrylic-ester copolymer, polymethyl methacrylate, butyl methacrylate resin, ethyl acrylate resin, butyl-acrylate resin and denaturation acrylate resin (silicone denaturation acrylate resin), vinyl chloride resin, vinyl chloride resin denaturation acrylate resin and acrylic urethane resin, styrene vinyl acetate copolymer, vinyl chloride vinyl acetate copolymer, rosin denaturation maleic resin, phenol resin, epoxy resin, polyester resin, polyester polyurethane resin, polyethylene, polypropylene, polybutadiene, polyvinylidence chloride, ionomer resin, polyurethane resin, silicone resin, ketone resin, ethylene ethyl acrylate copolymer, xylene resin and polyvinyl butyral resin, polyamide resin, denaturation polyphenylene-oxide resin, etc.

Moreover, as a material of an elastomer which constitutes the elastic belt, one or plural materials may be chosen from the following group of materials. The group of materials include isobutylene-isoprene rubber, fluorine including rubber, acrylic rubber, EPDM, NBR, acrylonitrile butadiene styrene rubber natural rubber, polyisoprene rubber, styrene butadiene, butadiene rubber, ethylene propylene rubber, ethylene propylene terpolymer, polychloroprene rubber, chloro sulfonation polyethylene, chlorinated polyethylene, polyurethane rubber, syndiotactic-1,2-polybutadiene, epichlorohydrin rubber, silicone rubber, fluororubber, polysulfide rubber, hydrogenation nitrile rubber, thermoplastic elastomer (for example, elastomer including polystyrene, polyolefine, polyvinyl chloride, polyurethane, polyamide, polyurea, polyester, fluororesin, etc.).

Although there is especially no limitation in the electric conduction agent for resistance regulation added to the elastic belt, what covered insulating particles, such as barium sulfate, magnesium silicate, and calcium carbonate, is sufficient as conductive metal oxides, such as metal powders, carbon black, graphite, aluminium, nickel, tin oxide, titanium oxide, antimony oxide, oxidation indium, potassium titanate, antimony-oxide tin-oxide multiple oxide (ATO), oxidation indium tin-oxide multiple oxide (ITO), conductive metal oxide, etc. The present invention is not limited to the above electric conduction agents.

Although there is no limitation in the outermost surface material, it is necessary for the material to reduce the adhesion force of the toner to the transfer belt surface and raise the secondary transfer property. For example, one or plural kinds of fine particles of the material that reduces the surface energy may be used, such as polyurethane, polyester and epoxy resin. Or, one or plural kinds of fine particles of the material that raises the lubricity may be used, for example, fluororesin, fluorine compound, fluoridation carbon, titanium oxides, silicone carbide.

Moreover, the heat-treated fluorine including rubber material may be used, which has the fluorine rich surface where the surface energy is reduced.

The manufacture method of the elastic belt according to the present invention is not limited. For example, any of the following methods may be used:

the centrifugal casting method which slushes material into the rotating mold of a cylinder form, and forms the elastic belt.

the spray coating method which makes the surface thin film form.

the dipping method which soaks the mold of a cylinder form into the solution of source material, and raises the mold from the solution.

the casting method in which source material is poured into a space between the inner and outer cores of the mold.

the method in which a compound is twisted around the mold of a cylinder form, and vulcanization polishing is performed.

Moreover, the elastic belt can be manufactured by combining two or more methods.

As a method of preventing the elongation of the elastic belt, there are the method of forming a rubber layer in a core resin layer with little elongation, and the method of including the ingredients which prevent elongation to the core layer, etc. However, the present invention is not limited to these methods.

As a material which constitutes the core layer which prevents elongation, any of the following group of materials may be used. The group of materials include textile fabrics, yarns using one chosen from the group including metal fibers, inorganic fibers, synthetic fibers, natural fibers, such as cotton and silk, polyester fibers, nylon fibers, acrylic fibers, polyolefine fibers, vinylon, polyvinyl chloride fibers, polyvinylidence chloride fibers, polyurethane fibers, polyacetal fibers, polyfluoroethylene fibers, phenol fibers, carbon fibers, glass fibers, boron fibers, iron fibers, copper fibers, etc. The present invention is not limited to these materials.

Yarns may be twisted yarns, such as those with one or plural filaments twisted, single-strand yarns, plied yarns, double thread yarns, etc. Moreover, it is possible to mix the fibers of different kinds chosen from the material group.

The manufacture method of preparing the core layer according to the present invention is not limited. For example, the textile fabrics woven in the shape of a pipe can be put on the metal pattern, the method of preparing a covering layer on it, the method of the textile fabrics woven in the shape of a pipe being dipped in the liquid rubber, and preparing a covering layer in one side or both sides of the core layer, and yarns can be spirally twisted around the metal pattern in arbitrary pitch, and the method of preparing a covering layer on it.

The thickness of the elastic layer varies depending on the hardness of the elastic layer. If the thickness of the elastic layer is too thick, the surface expansion and contraction will become large and a crack will become easy to generate it on the surface. Moreover, since the amount of expansion and contraction becomes large, it is unsuitable that the thickness of the elastic layer is too large (about 1 mm or more).

According to the present invention, a proper range of the hardness HS of the elastic layer is repsented by the conditions: $10 \leqq HS \leqq 65$ degrees (JIS-A). Adjustment of the suitable hardness is needed with the layer thickness of the elastic belt. The material having a hardness below 10 degrees (JIS-A) has a difficulty in the forming of the elastic layer with a sufficient dimensional accuracy. This problem arises from that it is easy to receive shrinkage and expansion at the time of molding.

Moreover, a general method is to make the oil component contain to the base material when making it soft, if the continuation actuation is carried out in the state of pressurization, it has a difficulty that the oil component oozes out. It is found that the oil component which oozed out to the photoconductor contacting the intermediate transfer belt surface adheres to the image, and a horizontal beltlike irregularity appears in the image.

On the other hand, the material having a hardness above 65 degrees (JIS-A) provides the ability to form the elastic belt with a sufficient accuracy. The oil adhesion over the photoconductor can be reduced, but the effect of transfer property improvements, such as the omission of character inside, is not obtained. Moreover, firm bridging to the firm-bridging roller becomes difficult.

In the embodiment of FIG. 2, the charging unit 60, among the conponents which constitute the image formation unit 18, is provided in the shape of a roller, contacting the photoconductor 40 and applying voltage thereto. Hence, the surface of the photoconductor 40 is charged by the charging unit 60. Of course, a non-contact type charger may be used instead for this purpose.

Although a 1-component developer may be used as the developing unit, a two-component developer which includes a magnetic career and a non-magnetism toner is used as the developing unit 61 in the embodiment of FIG. 2. The developing unit 61 includes an agitating part 66 which agitates the two component developer and makes the developing sleeve 65 carry out the supply adhesion of the two component developer. A development part 67 transfers the toner of the two component developer from the developing sleeve 65 to the photoconductor 40, and let the agitating part 66 be a low position from the development part 67. Two parallel screws 68 are provided in the agitating part 66. Between the screws 68, it divides except for both ends with a separating board 69 (refer to FIG. 5). Moreover, the development case 70 is provided with a toner concentration sensor 71.

On the other hand, while countering the development part 67 with the photoconductor 40 through an opening of the development case 70 and forming the development sleeve 65, a magnet 72 is fixed and formed in the development sleeve 65.

Moreover, the development sleeve 65 is provided with a doctor blade 73, and the leading edge of the doctor blade 73 is arranged in the development sleeve 65.

And the conveyance circulation is carried out by agitating the 2 component developer with two screws 68, and the development sleeve 65 is provided. The developer supplied to the development sleeve 65 is retained by a magnet 72. Moreover, a magnetic brush is provided on the development sleeve 65. The end of the magnetic brush is cut off by the doctor blade 73 with the rotation of the development sleeve 65 at a proper quantity. The cut-off developer is returned to the agitating part 66.

On the other hand, among the developers on the development sleeve 65, the toner is transferred to the photoconductor 40 with the development bias voltage applied to the development sleeve 65, and forms the electrostatic latent image on the photoconductor 40 into a visible toner image.

After the formation of a visible toner image, the developer which remained on the development sleeve 65 is separated from the development sleeve 65 in the location that does not have the magnetism of the magnet 72, and returns to the agitating part 66. By this repetition, if the toner concentration in the agitating part 66 becomes low, it will be detected by the toner concentration sensor 71, and the toner is supplied to the agitating part 66.

Next, the primary transfer unit 62 is provided in the shape of a roller, and the intermediate transfer belt 10 is inserted, and the primary transfer unit 62 is in pressure contact with the photoconductor 40. The primary transfer unit 62 is not limited only to the shape of a roller but it may be formed with a conductive brush or a non-contacting corona charger, etc. Moreover, although either the indirect transfer method which arranges the transfer unit at the downstream part of the photoconductor, or the direct transfer method which arranged under pressure to the photoconductor may be used, the direct transfer method is desired for the miniaturization of the equipment, the cost saving, etc.

The photoconductor cleaning unit 63 is compressed against the photoconductor 40, and it is equipped with the cleaning blade 75 made of, for example, a polyurethane rubber.

In order to raise the cleaning capability, a contact brush is used together on the periphery of the photoconductor 40. In the embodiment of FIG. 2, the fur brush 76 having a contact conductive capability is provided in contact with the periphery of the photoconductor 40, and the fur brush 76 is roratable in the rotation direction indicated by the arrow. Moreover, the metal electric-field roller 77 which applies a bias voltage to the fur brush 76 is provided such that it is rotatable in the direction indicated by the arrow. The end of the scraper 78 is pressed against the electric-field roller 77. Furthermore, the recovery screw 79 which collects the removed toners is provided.

And the fur brush 76 which rotates in the counter direction to the rotating direction of the photoconductor 40 removes the remaining toner on the surface of the photoconductor 40. The toner adhering to the fur brush 76 is removed by the electric-field roller 77 to which the bias voltage is applied, the roller 77 contacting the fur brush 76 and being rotated in the counter direction to the rotating direction of the fur brush 76. The toner adhering to the electric-field roller 77 is cleaned by the scraper 78. With the recovery screw 79, the toner collected by the photoconductor cleaning unit 63 is brought near by one side of the photoconductor cleaning unit 63. With the toner recycle unit 80, it is returned to the developing unit 61 for the purpose of reuse.

The electric discharger 64 is made of a lamp, and it irradiates light and initializes the surface potential of the photoconductor 40.

The surface of the photoconductor 40 is uniformly charged by the charging unit 60 with the rotation of the photoconductor 40. The light L is irradiated from the exposure unit 21 (laser, LED, etc.) to the surface of the photoconductor 40 according to the information read by the scanner 300, and an electrostatic latent image is formed on the surface of the photoconductor 40.

Then, the developing unit 61 supplies the toner to the photoconductor surface, and the electrostatic latent image is formed into a visible toner image, and the visible toner image is transferred to the intermediate transfer belt 10 by the primary transfer unit 62.

Figure 3:
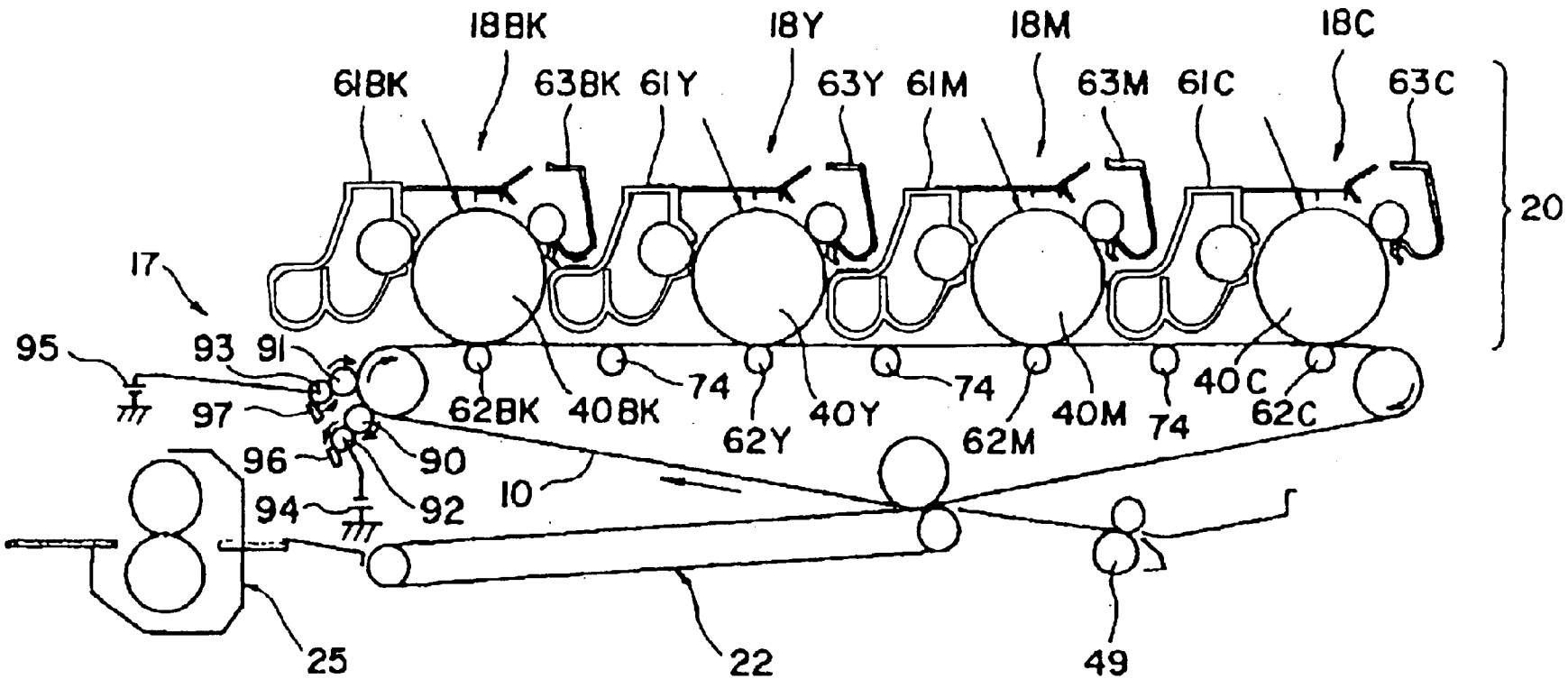
FIG. 3 is an enlarged FIG. of the principal elements of the image forming apparatus of FIG. 1.

The surface of the photoconductor 40 after the image transfer is cleaned by the photoconductor cleaning unit 63, and the remaining toner is removed therefrom. The photoconductor surface is discharged by the electric discharger 64, and the photoconductor 40 is placed in a waiting condition for a subsequent image formation. FIG. 3 shows the principal elements of the image forming apparatus of FIG. 1.

As shown in FIG. 3, the colors of respective photoconductors 40 of the image formation units 18 of the tandem image forming apparatus 20, and the colors of respective developing units 61, respective photoconductor cleaning units 63 of the image formation units 18, and the colors of respective primary transfer units 62 are indicated by the suffix following reference numeral: BK for black, Y for yellow, M for magenta, and C for cyan.

In addition, as in FIG. 3, the base layer side (the inner circumferential surface) of the intermediate transfer belt 10 is contacted between the primary transfer units 62, and the conductive roller 74 is provided. This conductive roller 74 prevents flowing into each image formation unit 18 by which the bias impressed with each primary transfer unit 62 adjoins through the base layer of inside resistance at the time of transfer.

Figure 4:
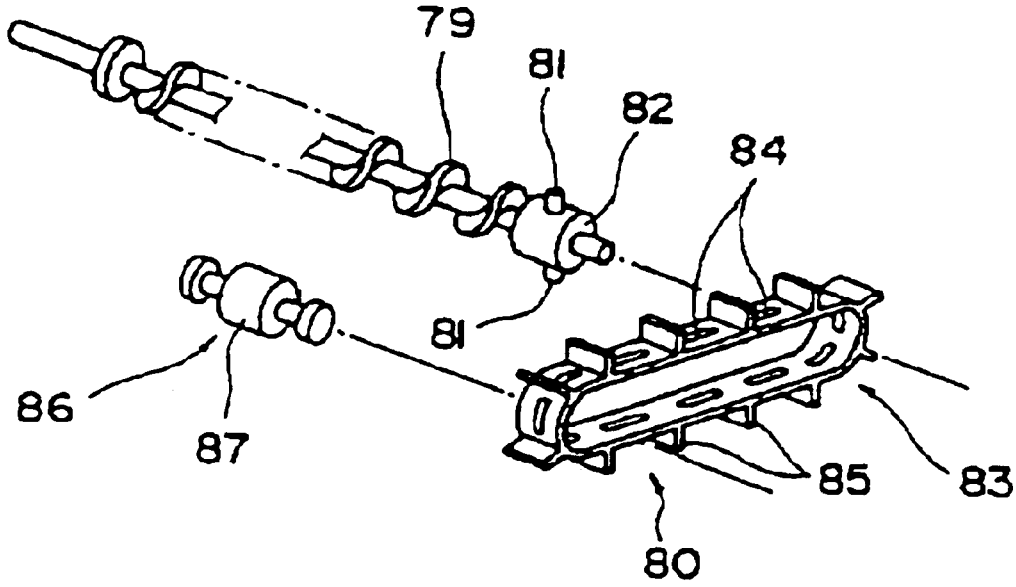
FIG. 4 is a perspective FIG. of a toner recycle unit.
Figure 5:
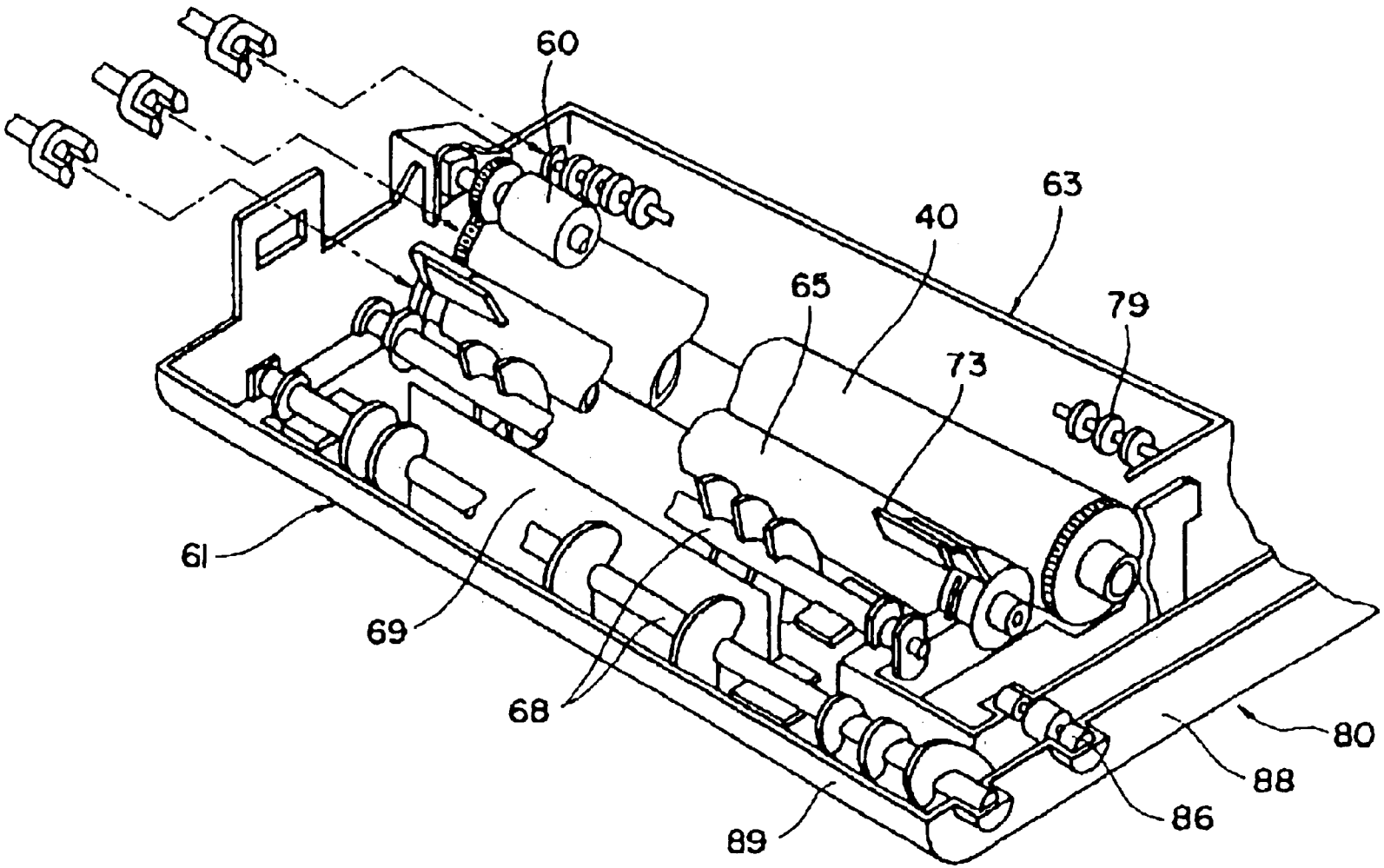
FIG. 5 is a perspective FIG. of a developing unit.
Figure 6:
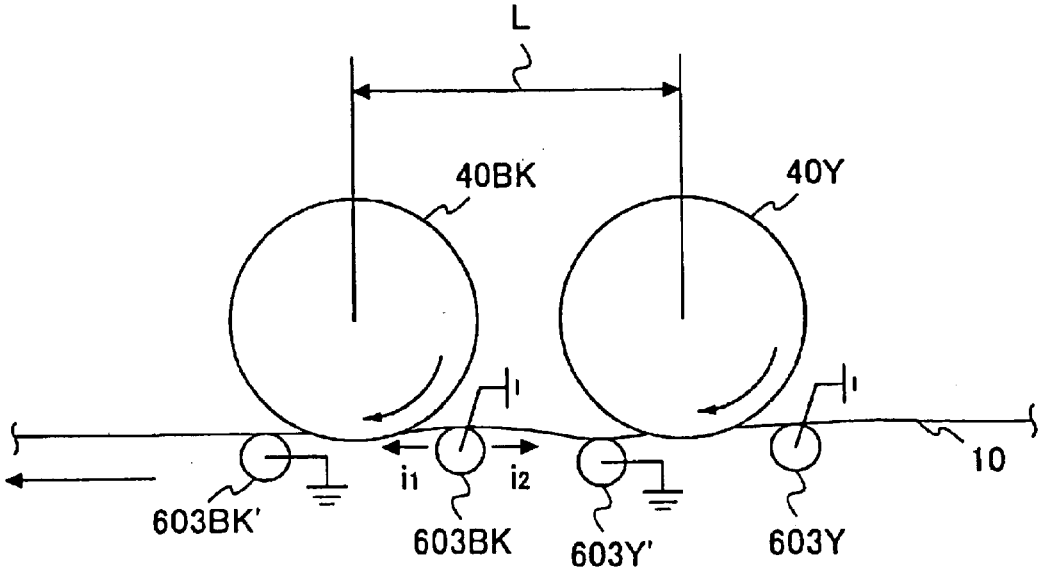
FIG.6 PRIOR ART
FIG. 6 is a diagram for explaining an indirect transfer method in a conventional tandem type image forming apparatus.
Figure 7:
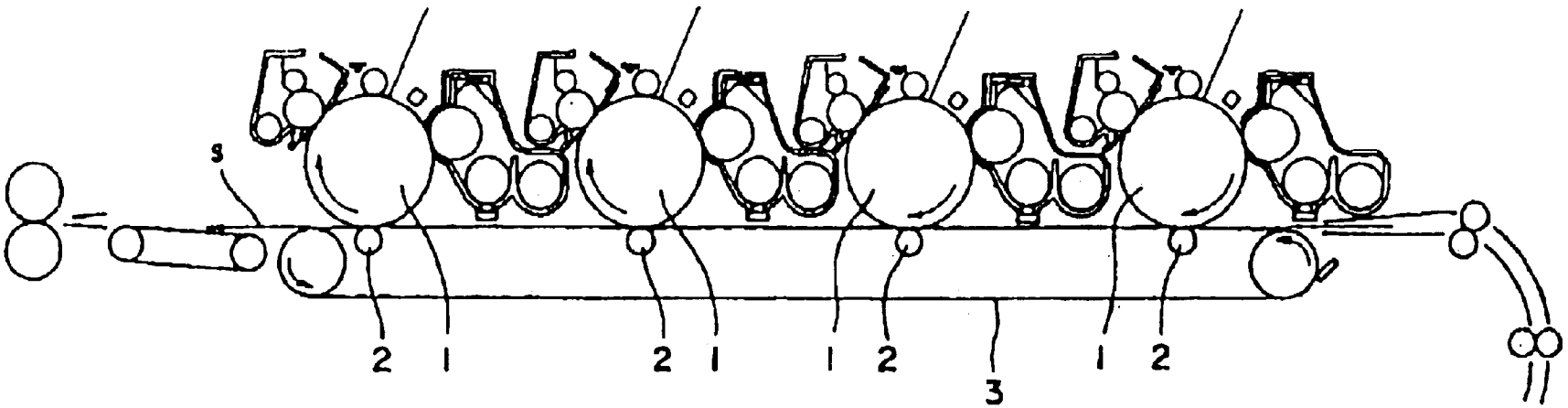
FIG.7 PRIOR ART
FIG. 7 is a diagram for explaining a direct transfer method in a conventional tandem type image forming apparatus.

Next, FIG. 4 shows the toner recycle unit 80 and FIG. 5 shows the developing unit 61. As shown in FIG. 4, the roller part 82 which has the pin 81 at the end thereof is provided in the recovery screw 79 of the photoconductor cleaning unit 63. With the roller part 82, one end of the belt-like recovery toner conveying part 83 of the toner recycle unit 80 is engaged. The pin 81 is attached to the slot 84 of the recovery toner conveyance part 83. On the periphery of the recovery toner conveyance part 83, the vanes 85 are provided at a fixed interval. The other end thereof is engaged with the roller part 87 of the rotation shaft 86.

The recovery toner conveyance part 83 is arranged together with the rotation shaft 86 in the conveyance passage case 88, as shown in FIG. 5. The conveyance passage case ois provided integrally with the cartridge case 89, and one of the two screws 68 of the developing unit 61 is connected to the end of the case 88 on the side of the developing unit 61.

By transmitting a driving force from the exterior, the recovery screw 79 is rotated and the recovery toner conveyance part 83 is rotated. The toner collected by the photoconductor cleaning unit 63 is conveyed to the developing unit 61 through the inside of the conveyance passage case 88, and it is supplied to the developing unit 61 by rotation of the screw 68. Then, the conveyance circulation is carried out with the developer being agitated by the two screws 68. The toner is supplied to the developing sleeve 65, and with the doctor blade 73, it is transferred to the photoconductor 40, and the latent image on the photoconductor 40 is developed.

The developing sleeve 65 is in the shape of a sleeve which is a non-magnetism rotation type, and, in the sleeve 65, two or more magnets 72 are provided. The magnets 72 are fixed and actract the developer when it passes through the predetermined location.

In the present embodment, the diameter of the developing sleeve 65 is set to 18 mm, and the surface of the developing sleeve 65 is processed by sand blast such that plural grooves having a depth of about 1 mm are formed, and the surface roughness Rz is in the range of 10–30 micrometers.

The magnet 72 has five magnetic poles of N1, S1, N2, S2 and S3 which are arranged in the rotation direction of the developing sleeve 65 from the location of the doctor blade 73.

The developer (or the toner) is attracted by a magnetic brush formed by the magnet 72, and held on the developming sleeve 65. The developing sleeve 65 is arranged so as to face the photoconductor 40, in the range near the S1 side of the magnet 72 where the magnetic brush for attracting the developer is formed by the magnet 72.

In the embodiment of FIG. 3, the two fur brushes 90 and 91 are provided as the cleaning members in the cleaning unit 17. Different-polarity bias voltages from the power supply (not shown) are applied to the fur brushes 90 and 91. In the fur brushes 90 and 91, the metal rollers 92 and 93 are cntacted so that they may be rotated in the forward or reverse direction, respectively. In the present embodiment, the (−) bias voltage from the power supply 94 is applied to the metal roller 92 at the upstream side of the rotating direction of the intermediate transfer belt 10, and the (+) bias voltage from the power supply 95 is applied to the metal roller 93 at the downstream side. The ends of the blades 96 and 97 are pressed against the metal rollers 92 and 93, respectively.

With the rotation of the intermediate transfer belt 10 in the direction (indicated by the arrow), the (−) bias is applied first, using the fur brush 90 by the upstream side, and the intermediate transfer belt 10 surface is cleaned. Temporarily, when −700V is applied to the metal roller 92, the fur brush 90 is set to −400V, and the (+) toner on the intermediate transfer belt 10 is transferred to the fur brush 90. The removed toner is further transferred to the metal roller 92 from the fur brush 90 with electric potential difference, and it is removed by the blade 96.

Although the fur brush 90 removes the toner on the intermediate transfer belt 10, the residual toner may exist on the intermediate transfer belt 10. Such toner is charged to the (−) polarity by the (−) bias voltage applied to the fur brush 90. This is considered to be charged according to charge injection or discharge.

However, such toner can be removed by subsequently applying the (+) bias using the fur brush 91 at the downstream side. The removed toner is transferred to the metal roller 93 from the fur brush 91 with electric potential difference, and it is removed by the blade 97. The toner which is removed by the blades 96 and 97 is collected on a toner tank (not shown).

In addition, the process cartridge of the present invention may be configured so that it includes at least the photoconductor 40 and all or some of the components of the image formation unit 18. The process cartridge may be provided such that it is removable from the main body 100 of the copier. The attachment and detachment of the process cartridge can be freely performed. By this configuration of the process cartridge, it is possible to provide ease of the maintenance.

Next, the photoconductor 40 used for the present invention is explained with reference to FIG. 8 through FIG. 11.

Figure 8:
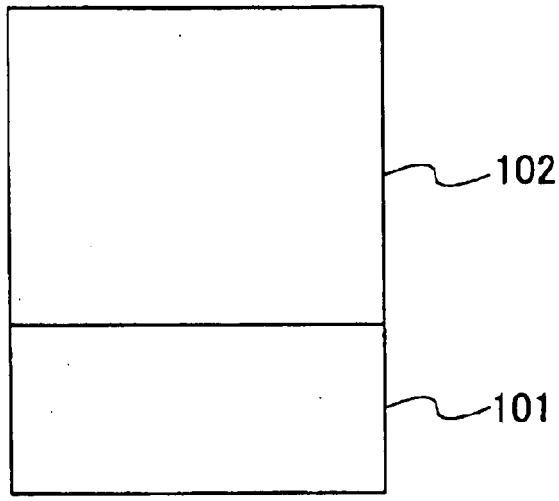
FIG. 8 is a diagram for explaining an example of the configuration of an electro-photographic photoconductor.

FIG. 8 shows an example of the configuration of the electro-photographic photoconductor of the present invention. The single photoconductive layer 102 is formed on the conductive support 101, and it is made of principal components including a charge generating substance and a charge transporting substance.

Figure 9:
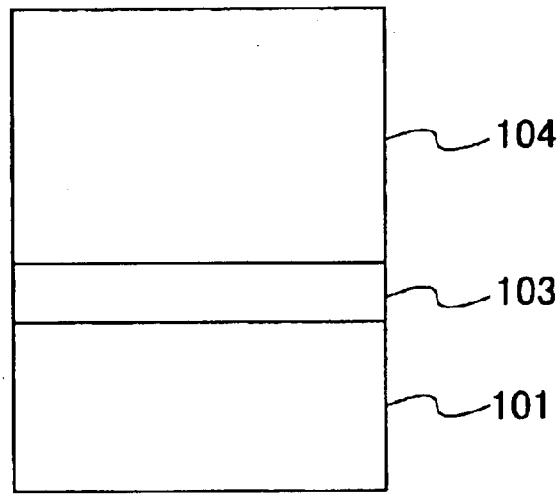
FIG. 9 is a diagram for explaining another example of the configuration of the electro-photographic photoconductor.

FIG. 9 shows another example of the configuration of the electro-photographic photoconductor of the present invention. The charge generating layer 103 and the charge transporting layer 104 are laminated as the photoconductive layer on the conductive support 101. The charge generating layer 103 is made of a charge generating substance as the principal component. The charge transporting layer 104 is made of a charge transporting substance as the principal component.

Figure 10:
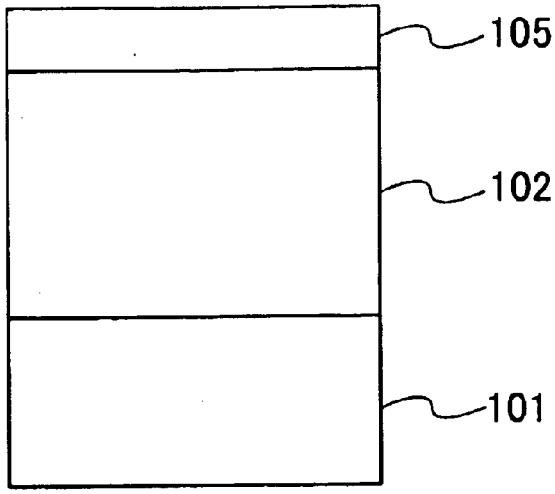
FIG. 10 is a diagram for explaining another example of the configuration of the electro-photographic photoconductor.

FIG. 10 shows another example of the configuration of the electro-photographic photoconductor of the present invention. The single photoconductive layer 102, which is made of the principal components: a charge generating substance and a charge transporting substance, is formed on the conductive support 101. Moreover, the protection layer 105 is further formed on the photoconductive layer 102.

Figure 11:
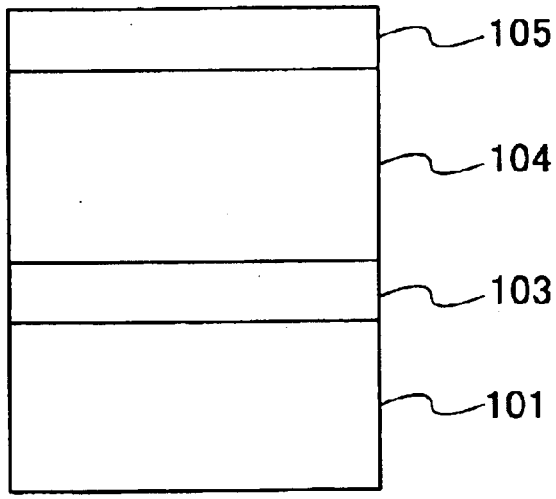
FIG. 11 is a diagram for explaining another example of the configuration of the electro-photographic photoconductor.

FIG. 11 shows another example of the configuration of the electro-photographic photoconductor of the present invention. The charge generating layer 103 and the charge transporting layer 104 are laminated as the photoconductive layer on the conductive support 101. The charge genarating layer 103 is made of a charge generating substance as the principal component. The charge transporting layer 104 is made of a charge transporting substance as the principal component. Moreover, the protection layer 105 is further formed on the charge transporting layer 104.

As a material of the conductive support 101, a conductive material which has a volume resistivity below 1010 ohm-cm may be used. One conceivable method to form the conductive support 101 is that any of metals, such as aluminium, nickel, chromium, nichrome, copper, gold, silver and platinum and metal oxides, such as tin oxide and indium oxideum is coated to a film-like or cylidrical plastic or paper by means of sputtering or vacuum deposition. Another method is that one or plural sheets of aluminium, aluminium alloy, nickel or stainless steel are extruded or drawn out to form a preform pipe, and the preform pipe is surface treated by cutting, super-finishing or polishing, and the surface-treated pipe can be used as the conductive support 101.

Moreover, the endless nickel belt and the endless stainless steel belt which are disclosed in Japanese Laid-Open Patent Application No. 52-36016 can also be used as the conductive support 101.

Furthermore, a coated support which is prepared by dispersing conductive fine particles and a suitable binder resin and coating the same onto the above-mentioned conductive support can also be used as the conductive support 101 of the present invention. The conductive fine particles include carbon black, acetylene black, metal power fine particles, such as aluminium, nickel, iron, nichrome, copper, zinc and silver, and metal oxide fine particles, such as conductive tin oxide, ITO, etc.

As for the binder resin which is used together with the conductive fine particles, any of the following resin materials may used: polystyrene, styrene acrylonitrile copolymer, styrene butadiene copolymer, styrene maleic anhydride copolymer, polyester, polyvinyl chloride, vinyl chloride vinyl acetate copolymer, polyvinyl acetate, polyvinylidence chloride, polyarylate resin, phenoxy resin, polycarbonate, cellulose acetate resin, ethyl-cellulose resin, polyvinyl butyral, polyvinyl formal, polyvinyl toluene, poly-N-vinylcarbazole, acrylate resin, silicone resin, epoxy resin, melamine resin, urethane resin, phenol resin, alkyd resin, etc.

The conductive layer can be prepared by dispersing and coating the conductive fine particles and the binder resin to a suitable solvent, for example, tetrahydrofuran, dichloromethane, methyl ethyl ketone, toluene, etc.

Furthermore, the conductive support which is prepared by forming the conductive layer on a suitable cylinder base with a thermal-contraction inner tube which is made of a suitable material, such as polyvinyl chloride, polypropylene, polyester, polystyrene, polyvinylidence chloride, polyethylene, chlorinated rubber, teflon, etc. and contain the conductive fine particles can also be used as the conductive support 101 of the present invention.

Either a laminated multi-layer type photoconductive layer in which the charge generating layer and the charge transporting layer are laminated or a single photoconductive layer in which the charge generating substance is dispersed in the charge transporting layer may be used as the photoconductive layer of the present invention.

A description will be given of the laminated type photoconductor which is prepared by laminating the charge generating layer 103 and the charge transporting layer 104 one by one. The charge generating layer 103 is a layer which is made of the charge generating substance as the principal component. The binder resin may be used in the charge generating layer 103 if needed.

As a material of the charge generating substance, any of inorganic materials and organic materials can be used. The inorganic materials include crystal selenium, amorphous selenium, selenium-tellurium, selenium-tellurium-halogen, and selenium-arsenic compound, amorphous silicone, etc.

On the other hand, a known material can be used as one of the organic materials of the charge generating substance. For example, phthalocyanine system pigments, such as metal phthalocyanine and non-metal phthalocyanine, azulenium salt pigment, square rucksack acid methin pigment, azo pigment having carbazole frame, azo pigment having triphenylamine frame, azo pigment having diphenylamine frame, azo pigment havng dibenzothiophene frame, azo pigment having oxadiazole frame, azo pigment having vis stilbene frame, the azo pigment having distyriloxadiazole frame, azo pigment having distyrilcarbazole frame, perylene including pigment, anthraquinone or multi-ring quinone including pigment, quinone imine system pigment, diphenylmethane and triphenylmethane-color including pigment, benzoquinone and naphthoquinone inclduign pigment, cyanine and azomethine including pigment, indigoid including pigment, vis benzimidazole including pigment, etc. These charge generating substances can be used as one or plural kinds of mixtures.

As a material of a binder resin used for the charge generating layer 103 if needed, any of polyamide, polyurethane, epoxy resin, polyketone, polycarbonate, polyarylate, silicone resin, acrylate resin, polyvinyl butyral, polyvinyl formal, polyvinyl ketone, polystyrene, poly-N-vinylcarbazole, polyacrylamide, etc. may be used. These binder resins may be used as one or plural kinds of mixtures. Moreover, it is possible to add a low molecule charge transporting substance if needed.

There are an electron transporting substance and a positive hole transporting substance as the charge transporting substance which can be used together in the charge generating layer 103.

As a material of the electron transporting substance, any of chloroanil, bromoanil, tetracyanoethylene, tetracyano quinodimethan, 2, 4, 7-trinitro-9-fluorenone, 2, 4, 5, 7-tetranitro-9-fluorenone, 2, 4, 5, 7-tetranitroglycerine xanthone, 2, 4, 8-trinitroxanthone, 2, 6, 8-trinitro-4H-indino [1,2-b] thiophene 4-on, 1, 3, 7-trinitro-dibenzothiophene-5, 5-dioxide. These are electron receptive substances. These electron transporting substances can be used as one or plural kinds of mixtures.

As a material of the electron-donative substance, any of the following group of materials may be used. The group of materials include oxazole derivative, oxadiazole derivative, imidazole derivative, triphenylamine derivative, 9-(p-diethyl amino styril anthracene), 1,1-vis-(4-dibenzyl amino phenyl)propane, styrilanthracene, styrilpyrazoline, phenylhydrazone, alpha-phenyl stilbene derivative, thiazole derivative, triazole derivative, phenazine derivative, acridine derivative, benzofuran derivative, benzimidazole derivative, thiophene derivative, etc. These positive hole transporting substances can be used as one or plural kinds of mixtures.

The principal components of the charge generating layer 103 are the charge generating substance, the solvent and the binder resin. In the charge generating layer 103, any of a sensitizer, a dispersant, a surface active agent and a silicone oil may be contained as the additives.

The vacuum thin film producing method and the method of casting from solution dispersed materials may be used as the method of forming the charge generating layer 103. The former method includes the vacuum deposition method, the glow discharge decomposing method, the ion-plating method, the sputtering method, the reactive-sputtering method, the CVD method, etc. The above-mentioned inorganic including materials and organic including materials can be used.

Moreover, in order to prepare the charge generating layer by the casting method, if required, a ball mill, a sand mill, etc. will disperse the inorganic or organic charge generating substance using solvents, such as tetrahydrofuran, cyclohexanone, dioxane, dichloroethane, and butanone, with the binder resin, and it can form by diluting distributed liquid moderately and applying it. The application can be performed by using the dip-painting method, the spray coat method, the bead coat method, etc.

As described above, about 0.01–5 micrometers is suitable for the thickness of the charge generating layer 103 mentioned above. More suitably, the thickness is in the range of 0.05–2 micrometers.

The charge transporting layer 104 is formed by dissolving or dispersing the mixture or copolymer, which contains a charge transporting component and a binder component as the principal components, to a suitable solvent, and by applying this and drying. About 10–100 micrometers is suitable for the thickness of the charge transporting layer 104, and when resolving power is required, about 10–30 micrometers is suitable for the thickness.

The high molecular compound which can be used as a binder component according to the present invention is as follows. For example, polystyrene, styrene/acrylonitrile copolymer, styrene/butadiene copolymer, styrene/maleic anhydride copolymer, polyester, polyvinyl chloride, vinyl chloride/vinyl acetate copolymer, polyvinyl acetate, polyvinylidence chloride, polyarylate resin, polycarbonate, cellulose acetate resin, ethyl-cellulose resin, polyvinyl butyral, polyvinyl formal, polyvinyl toluene, acrylate resin, silicone resin, fluororesin, epoxy resin, melamine resin, urethane resin, phenol resin, alkyd resin, etc. These are thermoplasticity or thermosetting resins. One or plural kinds of mixtures may be used, and the high molecular compounds can be copolymerized with the charge transporting substance.

As materials of the charge transporting substance, the above-mentioned low molecule type electron transporting substance and the positive hole transporting substance may be used. The amount of the charge transporting substance used per 100 parts of the high molecular compound by weight is in the range of 20–200 parts by weight. It is more suitably, in the range of 50–100 parts by weight.

As a distributed solvent which can be used as the charge transporting layer coating liquid, any of esters, such as halogen ester or aromatic ester, ethers, such as ketone ether, methyl ethyl ketone, acetone, methyl isobutyl ketone, cyclohexanone, dioxane tetrahydrofuran, ethyl cellosolve toluene, and xylene, chlorobenzene, dichloromethane, ethyl acetate, butyl acetate, etc.

Furthermore, when the charge transporting layer 104 is pprovided as the outermost surface layer of the photoconductor, at least a filler material is contained in the surface portion of the charge transporting layer 104. As the filler material, there are organic filler materials and inorganic filler materials. The organic filler materials include fluororesin powder such as polytetra-fluoroethylene, silicone resin powder, a-carbon powder, etc. The inorganic filler materials include metal powders, such as copper, tin, aluminium and indium, silica, tin oxide, zinc oxide, titanium oxide, alumina, oxidation indium, antimony oxide, metal fluoride, metal oxide, oxidation indium doped with tin oxide or bismuth oxide, calcium oxide, antimony, tin, fluoridation tin, calcium fluoride, fluoridation aluminium, potassium titanate, boron nitride, etc.

Compared with the filler containing an organic material, the hardness is high, and the filler containg an inorganic pigment can raise more the wear resistance of the outermost surface of the latent image support. Thereby, the abrasion of the outermost surface of the latent image support can be prevented.

However, although the surface part of the latent image support stops almost abrading out generally when the wear resistance of the latent image support is raised, by the reactant gas which occurs at the time of charging, such as ozone and NOx, the surface part will form low resistance, the electrostatic load of the surface part will no longer be retained gradually, and the electrostatic load will transfer in the direction of the surface.

Consequently, an electrostatic latent image spreads and the unusual image is seen when the electrostatic latent image is developed by the toner, and an image flow comes to happen. Then, as for the filler used by the present invention, it is desirable to have a high resistance more than of $10^{10}$ ohm-cm. By using the above filler, the problem of the low resistance of the outermost surface of the latent image support can be prevented and the occurrence of unusual images can be inhibited remarkably.

In such fillers, it is advantageous to use the inorganic material for wear resistance improvement from the point of the hardness of the filler. Especially, silica, titanium oxide and alumina can be used effectively. Moreover, one or plural kinds of mixtures of such filler materials may be used. Especially, the use of silica, titanium oxide or alumina makes it possible to reduce the manufacturing cost of the latent image support, since they are inexpensive and the acquisition is easy, when compared with other metal oxide particles. Alpha type alumina with high wear resistance and high insulation property is very useful for this purpose. The alpha type alumina enables the inhibition of image dotage and the improvement of wear resistance.

Such filler material can be dispersed by using a suitable equipment with the charge transporting substance, the binder resin, the solvent, etc. Moreover, the average of the primary grain size of the filler is in the range of 0.01–1.0 micrometers. More suitably, it is in the range of 0.05–0.5 micrometers. The wear resistance may become inadequate when the average of the primary grain size of the filler is below 0.01 micrometers. On the other hand, when the average of the primary grain size of the filler is above 0.5 micrometers, the light irradiated to the latent image support may be scattered by the filler, the permeability may fall, and the problem of image dotage or character thickening may arise.

Although the filler concentration in a surface layer changes with the electro-photographic process conditions of the photoconductor and with the kind of the filler used, the filler concentration is desirably in a range of 5–60% by weight.

Moreover, although it is possible that the entire charge transporting layer contains these fillers, it is desired to provide a filler concentration inclination for the charge transporting layer 104 so that the filler concentration is made higher one by one toward the surface side from the conductive support 101 side. Or, it is desired to provide a multi-layer charge transporting layer 104 so that the outermost surface of the charge transporting layer 104 may have the highest filler content and the conductive support 101 side may become low, since there is a case where the electric potential of the exposure unit may become high.

For example, what is necessary is just to carry out a laminating coating one by one from the coating liquid with few amounts of fillers etc. toward the outermost surface side from the conductive support 101 side, using the coating liquid for the charge transporting layer formation with which the amounts of fillers differ two or more, in constituting the charge transporting layer 104 in two or more layers.

In this case, the outermost layer of the multi-layer charge transporting layer 104 on the side of the outermost surface needs to have a ratio of the filler to all the solid contents (the filler content) that is in a range of 3–50% by weight. More suitably, it is in a range of 3–30% by weight.

On the other hand, the innermost layer of the charge transport layer 104 on the side of the conductive support 101 needs to have the filler content that is in a range of 5–30% by weight. More suitably, it is in a range of 5–10% by weight.

Next, a description will be given of the case where the single photoconductive layer is provided. In the single photoconductive layer 102, a charge generating substance, a charge transporting substance and a binder resin are dissolved or dispersed in a suitable solvent. The single photoconductive layer 102 can be formed by applying the above solution and drying it.

Moreover, a plasticizer, a leveling agent, an antioxidant, etc. can also be added to the above solution when the necessity arises.

As for the binder resin, it is possible to mix and use the binder resin mentioned as a binder resin in the charge generating layer 103 other than the binder resin previously mentioned in the charge transporting layer 104. The ratio of the charge generating substance to the binder resin of 100 weight parts needs to be in a range of 5–40 weight parts. The ratio of the charge transporting substance to the binder resin of 100 weight parts needs to be in a range of 0–190 weight parts, and, more suitably, it is in a range of 50–150 weight parts.

The single photoconductive layer 102 is formed by performing the coating of a coating liquid using any of the dip-painting method, the spray coat method, or the bead coat, such that the coating liquid is prepared by dispersing the charge generating substance, the charge transporting substance and the binder resin in a suitable solvent, such as tetrahydrofuran, dioxane, dichloroethane or cyclohexane, by means of a dispersing machine or the like. A suitable thickness of the single photoconductive layer 102 is in a range of 5–25 micrometers.

In the case where the single photoconductive layer 102 is used as the outermost surface of the photoconductor, the surface of the photoconductive layer is made to contain at least a filler. at least in composition in which the single photoconductive layer 102 is used as the outermost surface layer. Also in this case, like the case of the charge transporting layer 104, although the filler can also be contained in the entire photoconductive layer, it is effective that a filler concentration gradient be provided, or the composition of a multi-layer photoconductive layer wherein the filler concentration is varied for each layer be considered. One or plural kinds of the filler materials mentioned above may be used.

In the photoconductor of the present invention, as shown in FIG. 10 or FIG. 11, the protection layer 105 may be formed on the photoconductive layer. As a material of the protection layer 105, any of the following group of materials may be used. The group of materials include ABS resin, ACS resin, olefin vinyl monomer copolymer, chlorinated polyether, aryl resin, phenol resin, polyacetal, polyamide, polyamidoimide, polyacrylate, polyallyl-compound sulfone, polybutylene, polybutylene terephthalate, polycarbonate, polyether sulfone, polyethylene, polyethylene terephthalate, polyimide, acrylate resin, polymethylpentene, polypropylene, polyphenylene oxide, polysulfone, polystyrene, polyarylate, AS resin, butadiene-styrene coplymer, polyurethane, polyvinyl chloride, polyvinylidence chloride, epoxy resin, etc.

Moreover, when using the protection layer 105, the filler material is added to the protection layer 105. One or plural kinds of the filler materials may be used.

Such filler material can be dispersed using the conventional methods, such as a ball mill or a sand mill, and a supersonic wave, with the charge transporting substance, the binder resin, the solvent, etc. As for the average of the primary grain size of the filler, the average of the primary grain size of the filler in the range of 0.01–0.8 micrometers is desirable from the standpoint of the light transmittance and the wear-resistance of the protection layer 105.

Moreover, it is an effective means to the improvement in quality of image to add the charge transporting substance to the protection layer 105 in the charge transporting layer 104.

As a method of forming the protection layer 105, any of the conventional methods, such as the dip-painting method, the spray coat method, the bead coat method, the nozzle coat method, the spinner coat method and the ring coat method, can be used. In addition, about 0.1–10 micrometers is suitable for the thickness of the protection layer 105.

Moreover, as the thickness of the charge transporting layer 104 varies depending on the thickness of the protection layer 105, it is possible to provide an inclination in the filler concentration of the layer. That is, when the thickness of the protection layer 105 is large, it is desirable that a filler content of the layer becomes large toward the side of the conductive support 101 to the outermost surface side by the reason explained about the charge transporting layer 104.

In the photoconductor of the present invention, the coefficient of friction of the outermost surface of the photoconductor needs to be in a range of 0.1–0.7 according to Euler belt method. More suitably, it is in a range of 0.1–0.5 according to the Euler belt method.

The Euler belt method is adopted in the present invention as the quantification method of the photoconductor surface frictional coefficient, which will be described below.

A belt-like measuring member which is prepared by cutting of a middle-thickness bond paper so that the direction of paper milling becomes the longitudinal direction is contacted to the ¼ section of the periphery of the cylinder of the electro-photographic photoconductor. The load of 100 g is applied to one end of the member (the lower end) and a force gauge is connected to the other end thereof. After this, the force gauge is moved at a fixed velocity, and the value of the force gauge when the belt-like measuring meber starts movement is read. Then the coefficient of friction is computed by the following formula based on the measured value:

$$\mu s = 2/\pi \times In(F/W)$$

where $\mu s$ is a static frictional coefficient, F is the reading (g) of the force gauge, and W is the load (100 g).

When the coefficient of friction is too small, the recording medium (the paper) is easy to slide on the photoconductor surface. It is expected that the above problem of color gaps and banding images can be inhibited, and the undesired spot image can be also inhibited by the increase of the transfer efficiency. However, on the other hand, the toner is not easily attached to the photoconductor surface, and a desired picture quality may not be obtained.

Moreover, the cleaning blade which serves to clean the photoconductor surface easily slides. It becomes difficult to scratch or remove the low-resistance discharge products that are generated at the time of charging and adhere to the photoconductor surface. If the discharge products exist on the photoconductor surface, it will become the factor that causes unusual images, such as image flowing, under high-humidity environmental conditions.

When the coefficient of friction is larger than 0.7, the recording medium (the paper) is hard to slide on the photoconductor surface. The above problem of banding images arises, or it may become the cause of the undesired spot image by the decline of the transfer efficiency.

In the photoconductor of the present invention, an undercoat layer (not shown) may be provided between the conductive support 101 and the photoconductive layer. Generally, the undercoat layer is made of a resin as the principal component. However, the photoconductive layer is formed on the undercoat layer by applying the coating liquid to the undercoat layer. It is desirable that the resin as the material of the undercoat layer has a high solvent resistance to the general-purpose organic solvent.

As such a resin, a curing type resin which forms a three-dimensional network structure is suitable for the undercoat layer. Such resin materials include polyurethane, melamine resin, phenol resin, alkyd melamine resin, epoxy resin, etc. Other suitable resin materials include water soluble resins, such as polyvinyl alcohol, casein and polyacrylic-acid sodium, alcoholic soluble resins, copolymerization nylon and methoxy methylation nylon, etc.

Moreover, it is possible to add to the undercoat layer a powder pigment of metal oxide, such as titanium oxide, silica, alumina, zirconium oxide, tin oxide, oxidation indium, etc. because of moire prevention, reduction of remaining electric potential, etc.

The undercoat layer can be formed by using a suitable solvent and a coating method similar to the photoconductive layer. Furthermore, as the undercoat layer of the present invention, a silane coupling agent, a titanium coupling agent, a chromium coupling agent, etc. can also be used. In addition, the undercoat layer which is formed by anodic oxidation of $Al_2O_3$, or formed by vacuum thin-film deposition of organic substances, such as polyparaxylene (parylene), or inorganic substances, such as $SiO_2$, $SnO_2$, $TiO_2$, ITO, $CeO_2$, etc. can be suitably used as the undercoat layer of the present invention. In addition, another conventional undercoat layer can also be used. A suitable thickness of the undercoat layer is in a range of 0–20 micrometers, and, more suitably, it is in a range of 2–10 micrometers.

In the photoconductor of the present invention, it is also possible to provide a middle layer between the photoconductive layer 102 and the protection layer 105. Generally, a binder resin is used for the middle layer as the principal component. As a matrial of the middle layer, any of the following resin materials may be used: polyamide, alcoholic soluble nylon, water-soluble polyvinyl butyral, polyvinyl butyral, polyvinyl alcohol, etc.

As the middle layer forming method, any of the above-described coating methods may be used. In addition, a suitable thickness of the middle layer is in a range of 0.05–2 micrometers.

In the present invention, for the purposes of the improvement of environment-proof nature and the prevention of residual potential rise and sensitivity decline, it is possible to add an antioxidant, a plasticizer, a lubricant, an ultraviolet absorber, a low molecule charge transporting substance, and a leveling agent to each layer of the charge generating layer 103, the charge transporting layer 104, the undercoat layer (not shown), the protection layer 105 and the middle layer (not shown).

Typical materials of the compounds which can be used for each layer will be described below.

As an antioxidant, any of the following materials can be added to each layer. However, the present invention is not limited to these examples.

(a) Phenol compounds:

2,6-di-t-butyl-p-cresol, butyl hydroxy anisole, 2,6-di-t-butyl-4-ethyl phenol, n-octadecyl-3-4'-hydroxy-3'-5'-di-t-butyl phenol, 2, 2'-methylene-vis-(4-methyl-6-t-butyl phenol), 2, 2'-methylene-vis-(4-ethyl-6-t-butyl phenol), 4, 4'-thiovis-(3-methyl-6-t)-butyl phenol, 4, 4'-butylydenevis-(3-methyl-6-t-butyl phenol), 1, 1, 3-tri-(2-methyl-4-hydroxy 5-t-butyl phenyl) butane, 1, 3, 5-tri-methyl-2, 4, 6-tri-(3,5-di-t-butyl-4-hydroxy benzyl) benzene, tetrakis-[methylene 3-(3,5-di-t-butyl-4-hydroxy phenyl) propionate] methane, via [3, 3'-vis-(4-hydroxy 3-t-butyl phenyl) butylic acid] glycol ester, and tocopherol.

b) Paraphenylene diamine compounds:

N-phenyl-N-isopropyl-p-phenylene diamine, N, N'-di-sec-butyl-p-phenylene diamine, N-phenyl N-sec-butyl-p-phenylene diamine, N, N-di-isopropyl-p-phenylene diamine, N, N-dimethyl-N, N-di-t-butyl-p-phenylene diamine, etc.

(c) Hydroquinone compounds:

2,5-di-t-octyl hydroquinone, 2,6-di-dodecyl hydroquinone, 2-dodecyl hydroquinone, 2-dodecyl 5-chloro hydroquinone, 2-t-octyl 5-methyl hydroquinone, 2-(2-octadecenyl)-5-methyl hydroquinone, etc.

(d) Organosulfur compounds:

Dilauril-3,3'-thiodipropionate, distearil-3,3'-thiodipropionate, tetradecyl-3,3-thiodipropionate, etc.

(e) Organophosphorus compounds:

Triphenyl phosphine, tri(nonyl phenyl) phosphine, tri(di-nonyl phenyl) phosphine, tri-cresil phosphine, tri(2,4-dibutyl phenoxy) phosphine, etc.

As a plasticizer, any of the following materials can be added to each layer. The present invention is not limited to these examples.

(a) Phosphate ester plasticizer:

Triphenyl phosphate, tricresyl phosphate, trioctyl phosphate, octyl diphenyl phosphate, trichloro ethyl phosphate, cresyl diphenyl phosphate, tributyl phosphate, tri-2-ethyl hexyl phosphate, triphenyl phosphate, etc.

(b) Phthalate ester plasticizer:

Dimethyl phthalate, diethyl phthalate, diisobutyl phthalate, dibutyl phthalate, diheptyl phthalate, di-2-ethyl hexyl phthalate, di-isooctyl phthalate, di-n-octyl phthalate, di-nonyl phthalate, di-isononyl phthalate, di-isodecyl phthalate, di-undecyl phthalate, di-tridecyl phthalate, di-cyclohexyl phthalate, benzyl butyl phthalate, butyl lauryl phthalate, methyl oleil phthalate, octyl decyl phthalate, di-butyl fumarate, di-octyl fumarate, etc.

(c) Aromatic carboxylate ester plasticizer:

Trioctyl trimellitate, tri-n-octyl trimellitate, octyl benzoate, etc.

(d) Aliphatic dibasic acid ester plasticizer:

Dibutyl adipate, di-n-hexyl adipate, di-2-ethyl hexyl adipate, di-n-octyl adipate, n-octyl n-decyl adipate, di-isodecyl adipate, di-capryl adipate, di-2-ethyl hexyl azelate, di-methyl sebacate, di-ethyl sebacate, dibutyl sebacate, di-n-octyl sebacate, di-2-ethyl hexyl sebacate, di-2-ethoxy ethyl sebacate, di-octyl succinate, di-isodecyl succinate, tetrahydro dioctyl phthalate, di-n-octyl tetrahydro phthalate, etc.

(e) Fatty-acid ester derivative:

Butyl oleate, a glycerol monochrome oleate, an acetyl methyl ricinoleate, pentaerythritol ester, dipentaerythritol hexa ester, triacetin, tributylin, etc.

(f) Oxyacid ester plasticizer:

Acetyl methyl ricinoleate, butyl acetyl ricinoleate, butyl phthalyl butyl glycolate, acetyl tributyl citrate, etc.

(g) Epoxy plasticizer:

Epoxy soybean oil, epoxy linseed oil, epoxy butyl stearate, epoxy decyl stearate, epoxy octyl stearate, epoxy benzyl stearate, epoxy hexa hydro dioctyl phthalate, epoxy hexa hydro di-decyl phthalate, etc.

(h) Dihydric alcohol ester plasticizer:

Diethylene glycol di-benzoate, tri-ethylene-glycol di-2-ethyl butyrate, etc.

(i) Chlorine-containing plasticizer:

Chlorinated paraffin, chlorinated diphenyl, chlorination fatty acid methyl, methoxy chlorination fatty acid methyl, etc.

(j) Polyester plasticizer:

Polypropylene adipate, polypropylene sebacate, polyester, acetylation polyester, etc.

(k) Sulfonic acid derivatives:

p-toluenesulfonamide, o-toluenesulfonamide, p-toluene sulfone ethyl amide, o-toluene sulfone ethyl amide, toluene sulfone-N-ethyl amide, p-toluene sulfone-N-cyclohexyl amide, etc.

(l) Citric acid derivatives:

Citric acid tri-ethyl, acetyl citric acid tri-ethyl, tri-butyl citrate, an acetyl tri-butyl citrate, an acetyl citric acid tree 2-ethyl hexyl, acetyl citric acid-n-octyl decyl, etc.

(m) Others:

Tarphenyl, camphor, 2-nitroglycerine diphenyl, dinonyl-naphthalene, methyl abietate, etc.

As a lubricant, any of the following materials can be added to each layer. However, the present invention is not limited to these examples.

(a) Hydrocarbon compounds:

Liquid paraffin, paraffine wax, micro wax, low polymerization polyethylene, etc.

(b) Fatty acid compounds:

Lauric acid, myristic acid, PAL thymine acid, stearic acid, arachidic acid, behenic acid, etc.

(c) Fatty acid amide compounds:

Stearoyl amide, palmityl amide, olein amide, methylene vis stearoyl amide, ethylene vis stearoyl amide, etc.

(d) Ester system compounds:

A lower-alcohol ester of fatty acid, polyhydric alcohol ester of fatty acid, fatty acid polyglycol ester, etc.

(e) Alcoholic system compounds:

Cetyl alcohol, stearoyl alcohol, ethylene glycol, polyethylene glycol, poly glycerol, etc.

(f) Metal soap:

Lead stearate, cadmium stearate, barium stearate, calcium stearate, zinc stearate, magnesium stearate, etc.

(g) Natural wax:

Carnauba wax, montan wax, candelilla wax, bees wax, whale wax, etc.

(h) Others:

A silicone compound, a fluorine compound, etc.

As an ultraviolet absorber, any of the following materials can be added to each layer. However, the present invention is not limited to these examples.

(a) Benzophenone compounds:

2-hydroxy-benzophenone, 2,4-dihydroxy-benzophenone, 2, 2', 4-trihydroxy-benzophenone, 2, 2', 4, 4'-tetrahydroxy-benzophenone, 2, 2'-dihydroxy 4-methoxy-benzophenone, etc.

(b) Salicylate compounds:

Phenyl salicylate, 2, 4 di t-butylphenyl 3, 5 di t-butyl 4 hydroxybenzoate, etc.

(c) Benzotriazol compounds:

(2-hydroxy phenyl)benzotriazol, benzotriazol(2-hydroxy 5-methylphenyl), benzotriazol(2-hydroxy 5-methyl henyl), 5(2-hydroxy 3-tartialbutyl5-methylphenyl)-chrolobenzotriazol, etc.

(d) Cyano-acrylate compounds:

Ethyl-2-cyano-3,3-diphenylacrylate, methyl-2-calbomethoxy 3 (paramethoxy)acrylate, etc.

(e) Kuenchar (metallic-complex compounds):

Nickel (2,2' thio vis (4-t-octyl) phenolate) normalbutyl amine, nickel dibutyl di-thio-carbamate, nickel dibutyl di-thio-carbamate, cobalt di-cyclohexyl di-thio-phosphate, etc.

(f) HALS:

Vis (2, 2, 6, 6-tetramethyl-4-piperidyl)sebacate, vis (1, 2, 2, 6, 6-penthametyl-4-pieridyl)sebacate, 1-[2-[3-(3,5-di-t-butyl-4-hydroxyphenyl)propionyloxy] ethyl]-4-[3-(3,5-di-t-butyl-4-hydroxy phenyl) propionyloxy]-2, 2, 6, 6-tetramethylpyridine, 8-benzyl-7, 7, 9, 9-tetramethyl-3-octyl-1, 3, 8-triazaspilo [4, 5] undecane 2,4-dion, 4-benzoyloxy-2, 2, 6, 6-tetramethyl piperidine, etc.

A description will now be given of some examples of the present invention. It should be noted that the present invention is not limited to the following examples. In addition, each part in the following description is described as being weight basis.

Example 1

(EX 1)

The alkyd resin ("Bekkoraito" M6401-50 from Dainippon Ink Chemicals, Inc.) of 15 weight parts and the melamine resin ("Super Bekkamin" G-821-60 from Dainippon Ink Chemical Kogyo K.K.) of 10 weight parts are dissolved in a solution of methyl-ethyl-ketone of 150 weight parts.

The titanium-oxide powder ("Taipeku" CR-97 from Ishihara Sangyo K. K.) of 80 weight parts which is surface treated with alumina and zirconium oxide, and the titanium-oxide powder ("Taipeku" CR-67 from Ishihara Sangyo K. K.) of 10 weight parts which is surface treated with alumina are added to this solution. It is dispersed for 24 hours by using a ball mill, and the coating liquid for the undercoating layer is produced.

The coating of the above coating liquid is carried out to an aluminium pipe with a diameter of 30 mm, a length of 340 mm and a thickness of 1 mm by the dip-painting method. It is dried for 20 minutes at 130 degrees C., and the undercoat layer having a thickness of 2 micrometers is formed.

Next, the polyvinylbutyral resin ("Esurekku" HL-S from Sekisui Chemical Co., Ltd.) of 4 weight parts is dissolved in a solution of cyclohexanone of 150 weight parts. In addition, the above solution is added to the tris azo pigment of 10 weight parts which is represented by the following formula 1. After 48-hour dispersion of the above solution using a ball mill, cyclohexanone of 210 weight parts is added further and it is dispersed for 3 hours with the ball mill. It is taken out in a container and diluted with a certain amount of cyclohexanone so that a solid content becomes 1.5% by weight.

Formula 1:

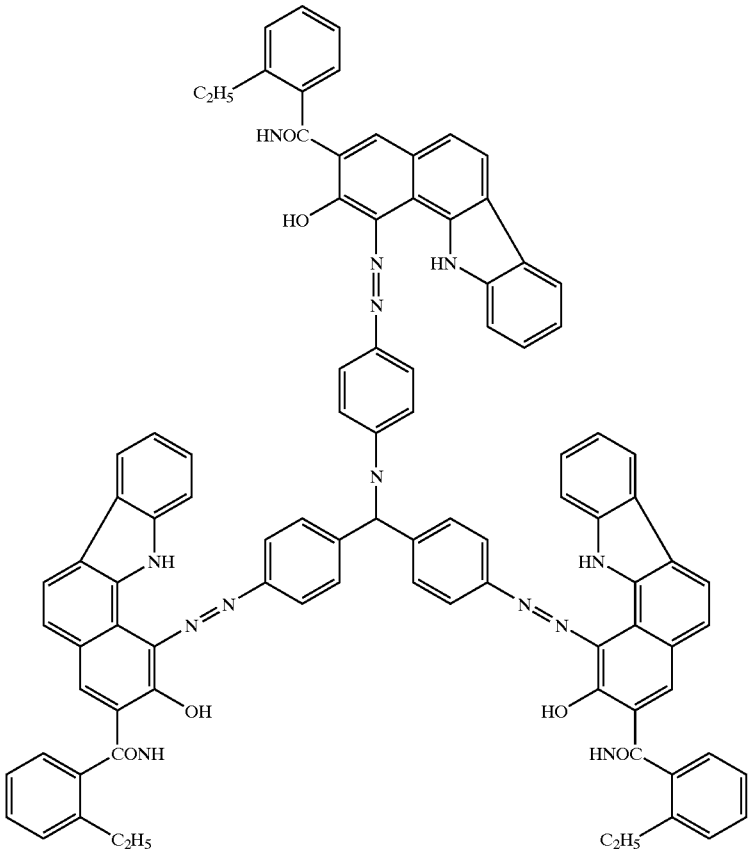

In this way, the coating of the thus obtained coating liquid for the charge generating layer is carried out by the dip-painting method on the undercoat layer. It is dried for 20 minutes at 130 degrees C., and the charge generating layer having a thickness of 0.2 micrometers is formed.

Next, the bisphenol Z type polycarbonate resin of 10 weight parts and the silicone oil (KF-50 from Shin-Etsu Chemical Co., Ltd.) of 0.002 weight parts are dissolved in a solution of tetrahydrofuran of 100 weight parts. The charge transporting substance of 8 weight parts which is represented by the following formula 2 is added to this. The coating liquid for the charge transporting layer is thud produced.

In this way, the coating of the obtained coating liquid for charge transporting layers is carried out by the dip-painting method on the charge generating layer. It is dried for 20 minutes at 110 degrees C. and the charge transporting layer having a thickness of 20 micrometers is formed, and the electro-photographic photoconductor is thus produced.

Formula 2:

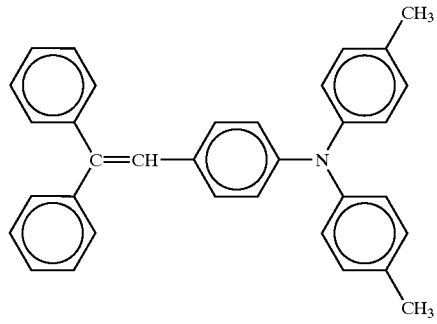

Next, the bisphenol Z type polycarbonate resin of 4 weight parts is dissolved in a mixed solvent of tetrahydrofuran of 80 weight parts and cyclohexanone of 280 weight parts. Alumina particles (specific resistance: $2.5\times10^{12}$ ohm-cm) of 0.7 weight parts are added to the above solution. In addition, it is dispersed for 2 hours by using a ball mill and the coating liquid for the protection layer is produced. In this way, the coating of the thus obtained coating liquid for the protection layer is carried out by the spray coating method on the charge transporting layer. It is dried for 20 minutes at 110 degrees C., and the protection layer having a thickness of 5 micrometers is formed. Hence, the electro-photographic photoconductor is produced.

Similarly, the four electrophotography photoconductors are produced. They are incorporated in the image forming apparatus of FIG. 1 (the PVDF resin belt in which carbon is dispersed is used as the intermediate transfer belt). The evaluation of images is performed after a total of 200,000 sheets including an initial image and 100,000 whole A4 surface monochrome (black) half-tone images, and 100,000 whole A4 surface full color half-tone images are output.

At this time, the speed difference between the photoconductor surface speed and the intermediate transfer belt surface speed is set to 0 in calculations, and the photoconductor and the intermediate transfer belt are drivn. However, in practice, a certain amount of the speed difference exists with errors of the elements and errors of drive systems.

Moreover, the thickness of an early photoconductive layer and the thickness of the photoconductive layer of the photo conductor for black after the 200,000-sheet image output are measured by using the eddy current type thickness gage ("Fischer Scope" MMS: the product from Fischer Co.). The abrasion loss of the photoconductive layer is measured by computing the difference of the measured thicknesses, and the abrasion loss of the coated film is 5.9 micrometers. Moreover, the coefficient of friction of the image support surface after the 200,000 sheet image output is also measured, and the measured coefficient of friction is 0.58.

Example 2

(EX 2)

The charge transportation substance of 3 weight parts of the above Formula 2 is added to the coating liquid for the protection layer of the Example 1, and it is considered as the coating liquid for the protection layer. The four electrophotographic photoconductors are produced in a similar manner to the Example 1. They are incorporated in the image forming apparatus of FIG. 1, and the same image evaluation as the Example 1, including the abrasion loss measurement and the coefficient of friction measurement, is performed.

Example 3

(EX 3)

The four electrophotographic photoconductors are produced in a similar manner to the Example 2, except having used the titanium-oxide particles for the coating liquid for the protection layer in the Example 2, instead of the alumina particles. They are incorporated in the image forming apparatus of FIG. 1, and the same image evaluation as the Example 2, including the abrasion loss measurement and the coefficient of friction measurement, is performed.

Example 4

(EX 4)

The four electrophotographic photoconductors are produced similar tot he Example 2 except having used the silica particles for the coating liquid for the protection layer of the Example 2 instead of the alumina particles. They are incorporated in the image forming apparatus of FIG. 1, and the same image evaluation as the Example 2, including the abrasion loss measurement and the coefficient of friction measurement, is performed.

Example 5

(EX 5) The four electrophotography photo conductors are produced similar to the Example 2 except having used the alumina particles of 1.8 weight parts instead of 0.7 weight parts in the Example 2. They are incorporated in the image forming apparatus of FIG. 1, and the same image evaluation as the Example 2, including the abrasion loss measurement and the coefficient of friction measurement, is performed.

Example 6

(EX 6)

The four electrophotographic photoconductors are produced in a similar manner to the Example 2 except having used the alumina particles of 0.14 weight parts instead of 0.7 weight parts in the Example 2. They are incorporated in the image forming apparatus of FIG. 1, and the same image evaluation as the Example 2, including the abrasion loss measurement and the coefficient of friction measurement, is performed.

Example 7

(EX 7)

The four electrophotographic photoconductors are produced in a similar manner to the Example 2 except having used the silicone oil SH200 (from Toray-Dow Corning-Silicone Co.) of 0.8 weight parts in the coating liquid for the protection layer in the Example 2. They are incorporated in the image forming apparatus of FIG. 1, and the same image evaluation as the Example 2, including the abrasion loss measurement and the coefficient of friction measurement, is performed.

Example 8

(EX 8)

The rotation speed of the electrophotographic photoconductor is made 1% higher than the transport speed of the intermediate transfer belt, except that it is made for the photoconductor and the intermediate transfer belt to drive, the same image evaluation as the Example 2, including the abrasion loss measurement and the coefficient of friction measurement, is performed.

Example 9

(EX 9)

In the image forming apparatus of the Example 2, the image evaluation is performed, after the sheet transport test, in a similar manner to the Example 2 except having used the intermediate transfer belt which is produced by using the following example of manufacture.

[Example of Manufacture of Elastic Intermediate Transfer Belt]

A cylindrical mold is dipped in a distributed liquid in which carbon black of 18 weight parts, a dispersant of 3 weight parts and toluene of 400 weight parts are unfiromyl dispersed to the PVDF of 100 weight parts. The mold is slowly raised at 10 mm/s, and it is dried at a room temperature, and a uniform film of PVDF having a thickness of 75 micrometers is formed.

The dipping of the mold with the PVDF film of 75 micrometer thickness in the solution is repeated in above-mentioned conditions, and the mold is raised at 10 mm/s, and it is dried at a room temperature so that a PVDF belt having a thickness of 150 micrometers is formed in the mold.

The cylindrical mold with which the above PVDF belt is formed is dipped in a distributed solution in which polyurethane prepolymer of 100 weight parts, curing agent (isocyanate) of 3 weight parts, carbon black of 20 weight parts, the dispersant of 3 weight parts, and the MEK of 500 weight parts are uniformly dispersed. The mold is slowly raised at 30 mm/s, and it is dried at a room temperature.

After the drying, the same procedure is repeated so that the urethane polymer layer having the intended thickness of 150 micrometers is formed.

Furthermore, for the preparation of the outermost layer, the polyurethane prepolymer of 100 weight parts, the curing agent (isocyanate) of 3 weight parts, the PTFE powder fine particles of 50 weight parts, the dispersant of 4 weight parts and the MEK of 500 weight parts are uniformly dispersed. The mold with the urethane polymer layer formed is dipped in the above solution, and it is raised at 30 mm/s. It is dried at a room temperature. The same procedure is repeated after the drying, so that the outermost surface of the urethane polymer in which the PTFE of 5 micrometers is uniformyl dispersed is formed. It is dried at a room temperature. The bridge formation is performed for 2 hours at 130 degrees C. The three-layer intermediate transfer belt is produced which includes the resin layer of 150 micrometer thickness, the elastic layer of 150 micrometer thickness, and the outermost surface of 5 micrometers.

[Comparative Example 1 (CE 1)]

The electrophotographic photoconductor and the intermediate transfer belt are driven and controlled such that the rotation speed of the photoconductor is 2% higher than the transport speed of the intermediate transfer belt in calculation. Except for this, the same image evaluation as the Example 2, including the abrasion loss measurement and the coefficient of friction measure, is performed.

[Comparative Example 2 (CE 2)]

The thickness of the charge transportation layer is set to 25 micrometers and no protection layer is prepared. Except for these, the four electrophotographic photoconductors are produced in a similar manner to the Example 1, and they are incorporated in the image forming apparatus of FIG. 1. The same examination as the Example 1 is performed. When 100,000 whole A4 surface monochrome (black) half-tone images are output, a background stain and a banding image appear. Moreover, the abrasion loss of the photoconductor at this time is 15 micrometers.

[Comparative Example 3 (CE 3)]

After zinc stearate is applied to the electrophotographic photoconductor surface of the Example 7, the photoconductors are incorporated in the image forming apparatus of FIG. 1 and the same image evaluation as the Example 1 is performed. An unusual image with low image concentration is output from the initial stage. Moreover, the coefficient of friction of the outermost surface of the photoconductor at this time is 0.06.

[Comparative Example 4 (CE 4)]

After electrostatic fatigue is given to the photoconductors of the Example 2 using a suitable test equipment which can perform the charging and the exposure to the photoconductors repeatedly, the photoconductors are incorporated in the image forming apparatus of FIG. 1, and the same image evaluation as the Example 1 is performed. A banding image appears from the initial stage. Moreover, the coefficient of friction of the outermost surface of the photoconductor at this time is 0.81.

Consequently, the measurement results of the image evaluation, the abrasion loss, and the coefficient of friction (COF) are as in the following Table 1:

TABLE 1

| | Initial COF | COF After $2 \times 10^5$ Out | Abrasion Loss After $2 \times 10^5$ Out (micrometer) | Picture Quality After $2 \times 10^5$ Out |
|---|---|---|---|---|
| EX 1 | 0.42 | 0.58 | 5.0 | undesired spot image slightly |
| EX 2 | 0.43 | 0.58 | 7.0 | undesired spot image slightly |
| EX 3 | 0.42 | 0.59 | 6.9 | undesired spot image slightly |
| EX 4 | 0.41 | 0.61 | 6.9 | undesired spot image slightly |
| EX 5 | 0.50 | 0.65 | 3.0 | undesired spot image slightly |
| EX 6 | 0.31 | 0.47 | 9.1 | good |
| EX 7 | 0.14 | 0.58 | 5.1 | good |
| EX 8 | 0.42 | 0.60 | 7.0 | good |
| EX 9 | 0.42 | 0.57 | 7.2 | good |
| CE 1 | 0.41 | 0.60 | 7.5 | color gap, banding |
| CE 2 | 0.38 | 0.59 | 15* | banding, background stain |
| CE 3 | 0.06 | — | — | initial density too low |
| CE 4 | 0.81 | — | — | initial banding image |

*the abrasion loss after 100,000-sheet output

As shown in Table 1, the coefficient of friction of the outermost surface of each latent image support according to the present invention is in a range of 0.1–0.7 according Euler belt method, and the difference between the rotation speed of the latent image support and the speed of the recording medium is 1% or less, and each latent image support according to the present invention has the outermost surface containing at least the filler and the binder resin. By using the image forming apparatus characterized by the above-mentioned latent image support, a good image can be output over an extended period of time without causing the problems of color gap, banding images, lack of image concentration, etc.

Moreover, a good image can be output over an extended period of time without causing the problem of undesired spot images etc. by using the image forming apparatus characterized in that the recording medium is the intermediate transfer belt, and the intermediate transfer belt is a seamless type elastic belt which is made of an elastic member at the outer peripheral surface thereof.

According to the image forming apparatus and the process cartridge of the present invention, the change of the outside diameter of a latent image support can be made small even in the repetition use or over an extended period of time, and it is possible to reliably produce a good full color image without outputting a banding image.

The present invention is not limited to the above-described embodiments, and variations and modifications may be made without departing from the scope of the present invention.

Further, the present invention is based on Japanese priority application No. 2001-192317, filed on Jun. 26, 2001, the entire contents of which are hereby incorporated by reference.

What is claimed is:

1. An image forming apparatus having a plurality of image formation units, each image formation unit comprising:

a latent image support supporting an electrostatic latent image;

a charging unit charging a surface of the image support;

a latent image formation unit forming an electrostatic latent image on the image support surface;

a developing unit developing the electrostatic latent image with toner to form a toner image on the image support; and a transfer unit transferring the toner image from the image support to a recording medium, the image forming apparatus comprising a recording medium transport unit transporting the recording medium so that the surfaces of the image supports of the plurality of image formation units are countered to a surface of the recording medium, respectively, wherein the surface of each image support has a coefficient of friction that is in a range of 0.1 to 0.7 according to Euler belt method, and a difference between a rotation speed of each image support and a transport speed of the recording medium is below 1%, and each image support has an outermost surface containing at least a filler and a binder resin.

2. The image forming apparatus of claim 1, wherein the respective toner images on the image supports are transferred to the recording medium by a direct transfer method, to form a color image on the recording medium by combination of the toner images.

3. The image forming apparatus of claim 1, wherein the recording medium is an endless intermediate transfer belt, and the image forming apparatus comprises an intermediate transfer unit respectively transferring the toner images, developed on the image supports, to the intermediate transfer belt, and the intermediate transfer unit transferring the combined toner image on the intermediate transfer belt to a copy sheet collectively.

4. The image forming apparatus of claim 3, wherein the intermediate transfer belt is a seamless type elastic belt that is made of an elastic member at an outer peripheral surface thereof.

5. The image forming apparatus of claim 1, wherein the image support of each image formation unit is configured with a photoconductive layer provided on a conductive support, and a filler content of the outermost surface of each latent image support is set to be larger than a filler content of the conductive support.

6. A process cartridge for use in an image forming apparatus, the image forming apparatus comprising:

a main body;

a latent image support supporting an electrostatic latent image;

a charging unit charging a surface of the image support;

a latent image formation unit forming an electrostatic latent image on the image support surface;

a developing unit developing the electrostatic latent image with toner to form a toner image on the image support;

a transfer unit transferring the toner image from the image support to a recording medium; and a recording medium transport unit transporting the recording medium so that the surface of the image support is countered to a surface of the recording medium, wherein the process cartridge includes the image support and at least one of the charging unit, the image formation unit, the developing unit, the transfer unit and an image support cleaning unit, which are integrally provided in the process cartridge, and the process cartridge is provided to be removable from the main body, wherein the surface of the image support has a coefficient of friction that is in a range of 0.1 to 0.7 according to Euler belt method, and a difference between a rotation speed of the image support and a transport speed of the recording medium is below 1%, and the image support has an outermost surface containing at least a filler and a binder resin.

* * * * *